US009595233B2

(12) United States Patent
Washio

(10) Patent No.: US 9,595,233 B2
(45) Date of Patent: Mar. 14, 2017

(54) DISPLAY DEVICE AND DRIVING METHOD THEREOF

(71) Applicant: Sharp Kabushiki Kaisha, Osaka-shi, Osaka (JP)

(72) Inventor: Hajime Washio, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 445 days.

(21) Appl. No.: 14/349,785

(22) PCT Filed: Oct. 4, 2012

(86) PCT No.: PCT/JP2012/075747

§ 371 (c)(1),
(2) Date: Apr. 4, 2014

(87) PCT Pub. No.: WO2013/054724

PCT Pub. Date: Apr. 18, 2013

(65) Prior Publication Data

US 2014/0267473 A1 Sep. 18, 2014

(30) Foreign Application Priority Data

Oct. 11, 2011 (JP) ..... 2011-223789

(51) Int. Cl.
*G09G 5/02* (2006.01)
*G09G 3/36* (2006.01)

(52) U.S. Cl.
CPC ..... *G09G 3/3659* (2013.01); *G09G 3/3607* (2013.01); *G09G 3/3688* (2013.01); *G09G 3/3614* (2013.01); *G09G 2310/0248* (2013.01)

(58) Field of Classification Search
CPC ..... G09G 2330/021; G09G 2310/0248; G09G 2310/0251; G09G 3/3614; G09G 2360/16; G09G 3/3607; G09G 2330/023
See application file for complete search history.

(56) References Cited

U.S. PATENT DOCUMENTS 6,642,916 B1 11/2003 Kodama et al.
2004/0246241 A1* 12/2004 Sato ..... G09G 3/325 345/204
2010/0220116 A1* 9/2010 Liao ..... G09G 3/3659 345/690

FOREIGN PATENT DOCUMENTS

JP 11-030975 A 2/1999
JP 2000-148098 A 5/2000

OTHER PUBLICATIONS

Official Communication issued in International Patent Application No. PCT/JP2012/075747, mailed on Dec. 25, 2012.

* cited by examiner

*Primary Examiner* — Kent Chang
*Assistant Examiner* — Mark Edwards
(74) *Attorney, Agent, or Firm* — Keating & Bennett, LLP

(57) ABSTRACT

An object of the invention is to provide a display device and a driving method thereof, in which uniformity of a video image displayed after charge sharing does not deteriorate. In a first horizontal period, a positive voltage and a negative voltage according to a video signal are alternately applied to source signal lines, and then, reset voltages of +5V and −5V are respectively applied to source signal lines. As a result, the voltages of the source signal lines become +5V or −5V. In this state, when the source signal lines to which +5V and −5V are applied are short-circuited in the beginning of a second horizontal period, charge sharing is performed between the source signal lines, and the voltages of these source signal lines become 0V. Subsequently, when the voltage according to the video signal is applied, the liquid crystal display device can display a color video image having reduced display unevenness and high uniformity.

13 Claims, 12 Drawing Sheets

(A)

FIRST HORIZONTAL PERIOD 1H(1)

(B)

SECOND HORIZONTAL PERIOD 1H(2)

(A)

SECOND HORIZONTAL PERIOD 1H(2)

(B)

THIRD HORIZONTAL PERIOD 1H(3)

(A)

SECOND HORIZONTAL PERIOD 1H(2)

(B)

THIRD HORIZONTAL PERIOD 1H(3)

DISPLAY DEVICE AND DRIVING METHOD THEREOF

TECHNICAL FIELD

The present invention relates to a display device and a driving method thereof, and more particularly, to a display device performing charge sharing and a driving method of the display device.

BACKGROUND ART

In recent years, the definition of a display unit is becoming higher and the size is becoming larger, so that noise at the time of driving, which exerts an influence on the quality of a video image displayed in the display unit is an issue. To reduce such noise, in a liquid crystal display device, the display quality of a video image is improved by performing dot-reversal driving or column-reversal driving in which a DC voltage is applied to an opposed electrode in each pixel and a positive video signal and a negative video signal are alternately applied to source signal lines.

However, the polarity of the video signal supplied to the source signal lines needs to be reversed every frame period. Particularly, in the dot-reversal driving, the polarity of the video signal also needs to be reversed every horizontal period (1H). In the case of reversing the polarity of the video signal as described above, the polarity of a driver video amplifier needs to be switched each time to increase the swing width of the video signal, so that the power consumption increases.

For example, as described in Patent Documents 1 and 2, a discharge circuit is provided for every two adjacent source signal lines, and the discharge circuits are simultaneously made conductive every horizontal period. At this time, a positive video signal is supplied to one of the source signal lines, and a negative video signal is supplied to the other source signal line. By making the signal lines conductive, charge sharing is performed between the adjacent source signal lines. By the charge sharing, the swing width of a video signal necessary at the time of reversing the polarity of the video signal decreases, so that the power consumption is reduced.

PRIOR ART DOCUMENTS

Patent Documents

[Patent Document 1] Japanese Patent Application Laid-Open No. H11-30975

[Patent Document 2] Japanese Patent Application Laid-Open No. 2000-148098

SUMMARY OF THE INVENTION

Problems to be Solved by the Invention

However, since the voltages according to the video signals applied to the source signal lines vary for each video signal, the voltage of each source signal line after performing the charge sharing in two adjacent source signal lines varies each time. Specifically, the voltage of the source signal line after charge sharing becomes 0V, positive voltage, or negative voltage. If the next video signal is supplied to such a source signal line, the voltage of the source signal line may be influenced by the voltage after the charge sharing and may become higher or lower than the voltage of the supplied video signal. In such a case, there is a problem that uniformity of a video image displayed in the display unit deteriorates.

An object of the present invention is therefore to provide a display device and a driving method thereof, in which uniformity of a video image displayed after charge sharing does not deteriorate.

Solution to the Problems

A first aspect of the present invention is directed to an active matrix-type display device comprising:

a display unit having a plurality of data signal lines, a plurality of scanning signal lines intersecting the plurality of data signal lines, and a plurality of pixels arranged in a matrix form at respective intersections of the plurality of data signal lines and the plurality of scanning signal lines;

a scanning signal line drive circuit sequentially selecting and activating the plurality of scanning signal lines;

a data signal line drive circuit which alternately applies a positive voltage and a negative voltage to the data signal lines; and a plurality of discharge circuits connecting the data signal lines to which the positive voltage is applied and the data signal lines to which the negative voltage is applied, the number of the data signal lines to which the positive voltage is applied being equal to the number of the data signal lines to which the negative voltage is applied, wherein the data signal line drive circuit alternately applies the positive voltage and the negative voltage according to the video signal to the data signal lines, and then applies first reset voltages whose absolute values are equal to and whose polarities are the same as those of the voltages according to the video signal to each of the data signal lines, and after the first reset voltages are applied to the data signal lines every horizontal period, the discharge circuit short-circuits the data signal lines connected to the discharge circuit.

In a second aspect of the present invention, based on the first aspect of the present invention, further comprising a selection circuit which divides the video signal including a plurality of color video signals representing video images of a plurality of colors, by each of the color video signals, wherein each of the pixels arranged in the display unit includes a plurality of sub-pixels corresponding to the plurality of color video signals, the data signal line includes a video signal line which time-divisionally divides the plurality of color video signals and outputs the resultant signals, and a plurality of sub data signal lines connected to the plurality of sub-pixels, the selection circuit supplies the voltages according to the plurality of color video signals to the plurality of sub data signal lines, the discharge circuit connects the sub data signal lines to which the positive voltage is applied and the sub data signal lines to which the negative voltage is applied, the number of the sub data signal lines to which the positive voltage is applied being equal to the number of the sub data signal lines to which the negative voltage is applied, the data signal line drive circuit alternately applies the positive voltage and the negative voltage according to the color video signal to each of the sub data signal lines, and then applies second reset voltages whose absolute values are equal to and whose polarities are the same as those of the voltages according to the color video signal to each of the data signal lines, and after the second reset voltages are applied to the sub data signal lines every horizontal period, the discharge circuit short-circuits the sub data signal lines connected to the discharge circuit.

In a third aspect of the present invention, based on the second aspect of the present invention, wherein time to apply the second reset voltage to the sub data signal line increases as the number of the sub data signal lines connected to each of the video signal lines increases.

In a fourth aspect of the present invention, based on the second aspect of the present invention, wherein the absolute value of the second reset voltage is equal to or less than the absolute value of maximum voltage and minimum voltage according to the color video signal.

In a fifth aspect of the present invention, based on the second aspect of the present invention, wherein the selection circuit is configured by an analog switch.

In a sixth aspect of the present invention, based on the second aspect of the present invention, wherein the discharge circuit connects two adjacent sub data signal lines.

In a seventh aspect of the present invention, based on the second aspect of the present invention, wherein the discharge circuit connects two closest sub data signal lines out of sub data signal lines to which the color video signal of the same color is supplied.

In a eighth aspect of the present invention, based on the second aspect of the present invention, wherein the pixel includes a red sub-pixel, a green sub-pixel, and a blue sub-pixel.

In a ninth aspect of the present invention, based on the eighth aspect of the present invention, wherein the second reset voltages of different polarities are applied to the sub data signal line connected to the red sub-pixel and the blue sub-pixel, and the sub data signal line connected to the green sub-pixel, respectively and time to apply the second reset voltages to the sub data signal lines connected to the red sub-pixel and the sub data signal lines connected to the blue sub-pixel is longer than time to apply the second reset voltages to the sub data signal lines connected to the green sub-pixel.

In a tenth aspect of the present invention, based on the second aspect of the present invention, wherein the data signal line drive circuit performs dot-reversal driving.

In a eleventh aspect of the present invention, based on the second aspect of the present invention, wherein the data signal line drive circuit performs column-reversal driving.

A twelfth aspect of the present invention is directed to a driving method of an active matrix-type display device including:

a display unit having a plurality of data signal lines, a plurality of scanning signal lines intersecting the plurality of data signal lines, and a plurality of pixels arranged in a matrix format respective intersections of the plurality of data signal lines and the plurality of scanning signal lines, a scanning signal line drive circuit sequentially selecting and activating the plurality of scanning signal lines, a data signal line drive circuit which alternately applies a positive voltage and a negative voltage to the data signal lines, and a plurality of discharge circuits connecting the data signal lines to which the positive voltage is applied and the data signal lines to which the negative voltage is applied, the number of the data signal lines to which the positive voltage is applied being equal to the number of the data signal lines to which the negative voltage is applied, the method comprising:

a first voltage applying step of alternately applying a positive voltage and a negative voltage according to a video signal to the data signal lines;

a second voltage applying step of, after application of the positive voltage and the negative voltage according to the video signal, applying a first reset voltage whose absolute value is equal to and whose polarity is the same as that of the voltage according to the video signal to each of the data signal lines; and a short-circuiting step of short-circuiting data signal lines connected to the discharge circuit by making the discharge circuit conductive after application of the first reset voltage every horizontal period.

In a thirteenth aspect of the present invention, based on the twelfth aspect of the present invention, wherein the display device further includes a selection circuit which divides the video signal including a plurality of color video signals representing video images of a plurality of colors, by color video signals, each of the pixels arranged in the display unit includes a plurality of sub-pixels corresponding to the plurality of colors, the data signal line includes a video signal line which time-divisionally divides the plurality of color video signals and outputs the resultant signals, and a plurality of sub data signal lines connected to the sub-pixels, in the first voltage applying step, the positive voltage and the negative voltage according to the plurality of color video signals are alternately applied to the plurality of sub data signal lines, in the second voltage applying step, the voltages according to the plurality of color video signals are applied to the plurality of sub data signal lines, and then, second reset voltages whose absolute values are equal to and whose polarities are the same as those of the voltages according to the color video signal are applied to each of the sub data signal lines, and in the short-circuiting step, after the second reset voltages are applied every horizontal period, the data signal lines connected to the discharge circuit are short-circuited.

Effects of the Invention

According to the first and twelfth aspects of the present invention, a positive voltage and a negative voltage according to a video signal are alternately applied to data signal lines every horizontal period. Next, a first reset voltage whose absolute value is equal to and whose polarity is the same as that of the voltage according to the video signal is applied to each of the data signal lines. Accordingly, not a voltage according to the video signal line but the first reset voltages whose absolute values are equal to and whose polarities are different are alternately applied to the data signal lines. In this state, when the data signal lines to which the first reset voltages are applied are short-circuited, charge sharing is performed between the data signal lines, and the voltages of the data signal lines become 0V. In the case of applying a voltage according to a video signal of the next horizontal period to such data signal lines, the voltage of the data signal line is not influenced by the video signal applied in the immediately preceding horizontal period. Consequently, the display device can display a video image having reduced display unevenness and high uniformity. The voltages whose absolute values are equal to and whose polarities are different include voltages which become a value close to 0V when the source signal lines are short-circuited and which exert substantially the same effect as the above.

According to the second and thirteenth aspects of the present invention, the positive voltage and the negative voltage according to the color video signal are alternately applied to the sub data signal lines every horizontal period. Next, second reset voltages whose absolute values are equal to and whose polarities are the same as those of the voltage according to the color video signal are applied to the sub data signal lines. In this manner, not the voltage according to the color video signal line, but the second reset voltages whose absolute values are equal to and whose polarities are different are alternately applied to the sub data signal lines. In this state, when the sub data signal lines to which the second reset voltages are applied are short-circuited, charge sharing is performed between the sub data signal lines, and the voltages of the sub data signal lines become 0V. In the case of applying the voltage according to the color video signal of the next horizontal period to such sub data signal lines, the voltage of the sub data signal line is not influenced by the color video signal applied in the immediately preceding horizontal period. Consequently, the display device can display a color video image having reduced display unevenness and high uniformity.

According to the third aspect of the present invention, the second reset voltages of the same polarity are simultaneously applied from one video signal line to one or two or more sub data signal lines. In the case where the number of sub data signal lines to which the second reset voltages are applied is large, time to charge the voltages of the sub data signal lines to the second reset voltage needs to be made longer. By increasing the charge time in accordance with the number of sub data signal lines and performing charging until the voltages of all of the sub data signal lines become the second reset voltages, the absolute values of the voltages of different polarities charged in the sub data signal lines become equal. Subsequently, the sub data signal lines charged with the second reset voltages of different polarities are short-circuited, and their voltages are set to 0V. In this manner, the display device can display a color video image having reduced display unevenness and high uniformity.

According to the fourth aspect of the present invention, the absolute value of the second reset voltages is smaller than the absolute value of a maximum value and a minimum value of a voltage according to the video signal. Therefore, power consumption of the data signal line drive circuit at the time of generating the second reset voltages can be reduced.

According to the fifth aspect of the present invention, an analog switch is a switch whose power consumption at the time of driving is small and having high current drivability. When an analog switch is used as the selection circuit, even if there are characteristic variations of thin film transistors which configure the analog switch, the sub data signal line can be charged in a short time. Since the sub data signal line can be charged to the second reset voltage in a short time, the display unevenness caused by insufficient charging of the sub data signal line can be reduced.

According to the sixth aspect of the present invention, it is sufficient to arrange a discharge circuit so as to connect two adjacent sub data signal lines. Therefore, the display device can be designed easily.

According to the seventh aspect of the present invention, the following effects are achieved in the case of using the display device in which two closest sub data signal lines out of sub data signal lines to which the color video signal of the same color is supplied are connected by the discharge circuit as a display device of monochromatically displaying only a video image of a specific color. Specifically, the second reset voltage is applied only to the sub data signal line to which a color video signal representing a specific color is supplied, and the color video signal is not supplied to the other sub data signal line. Therefore, the second reset voltages are also not applied to the sub data signal lines. In such a case, charge sharing is performed only between sub data signal lines to which the color video signal representing the specific color is supplied, so that charge re-distribution can be performed efficiently.

According to the eighth aspect of the present invention, the pixel includes a red sub-pixel, a green sub-pixel, and a blue sub-pixel, so that the display device can display a color video image.

According to the ninth aspect of the present invention, time to apply the second reset voltages simultaneously to the sub data signal lines connected to the red sub-pixel and the blue sub-pixel is set to be longer than time to apply the second reset voltages to the sub data signal lines connected to the green sub-pixel. Consequently, the voltages of all of the sub data signal lines can be charged to the second reset voltages. Next, the sub data signal lines charged with the second reset voltages of different polarities are short-circuited to set the voltages of the sub data signal lines to 0V. Therefore, the display device can display a color video image having reduced display unevenness and high uniformity.

According to the tenth aspect of the present invention, the display device having the data signal line drive circuit performing dot-reversal driving can display a video image having reduced display unevenness and high uniformity by short-circuiting sub data signal lines to which second reset voltages of different polarities are applied.

According to the eleventh aspect of the present invention, the display device having the data signal line drive circuit performing column-reversal driving can display a video image having reduced display unevenness and high uniformity by short-circuiting sub data signal lines to which second reset voltages of different polarities are applied.

BRIEF DESCRIPTION OF THE DRAWINGS

FIG. 4(A) is a diagram illustrating source signal lines which store video signals in sub-pixels of respective colors in a first horizontal period and to which reset voltage is thereafter applied, and FIG. 4(B) is a diagram illustrating the source signal lines short-circuited at the beginning of a second horizontal period.

FIG. 5(A) is a diagram illustrating source signal lines which store video signals in sub-pixels of respective colors in a second horizontal period and to which reset voltage is thereafter applied. FIG. 5(B) is a diagram illustrating the source signal lines short-circuited at the beginning of a third horizontal period.

FIG. 8(A) is a diagram illustrating source signal lines which store video signals in sub-pixels of respective colors in the second horizontal period and to which reset voltage is thereafter applied, and FIG. 8(B) is a diagram illustrating the source signal lines short-circuited at the beginning of the third horizontal period.

MODES FOR CARRYING OUT THE INVENTION

Hereinafter, embodiments of the present invention will be described with reference to the attached drawings.

1. First Embodiment

1.1 Configuration of Liquid Crystal Display Device

Figure 1:
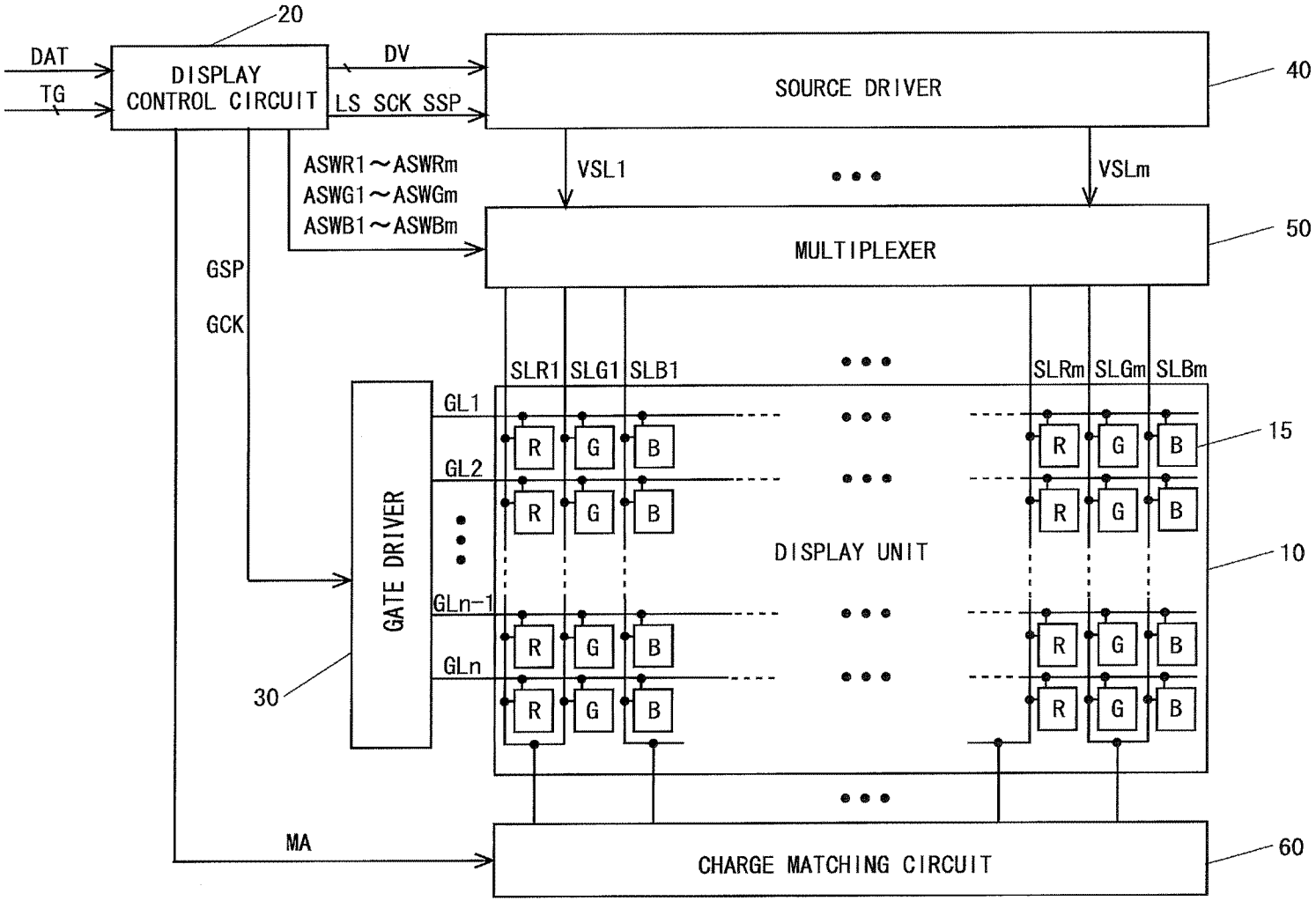
FIG. 1 is a block diagram illustrating a configuration of a liquid crystal display device according to a first embodiment of the present invention.

FIG. 1 is a block diagram illustrating a configuration of a liquid crystal display device according to a first embodiment of the present invention. A liquid crystal display device illustrated in FIG. 1 includes a display unit (liquid crystal panel) 10, a display control circuit 20, a gate driver (scanning signal line drive circuit) 30, a source driver (a data signal line drive circuit) 40, a multiplexer 50, and a charge matching circuit 60. In the following, each of m and n is an integer of one or more, i is an integer which is equal to or more than 1 and equal to or less than 3 m, and j is an integer which is equal to or more than 1 and equal to or less than n.

The display unit 10 includes (n×3 m) display elements 15, n gate signal lines GL1 to GLn, and 3 m source signal lines SLR1 to SLRm, SLG1 to SLGm, and SLB1 to SLBm (hereinafter, simply referred to as "SLR1 to SLBm"). The (n×3 m) display elements 15 have the same shape and the same size and are arranged in a matrix form of 3 m display elements 15 in the row direction (the lateral direction in FIG. 1) and n display elements 15 in the column direction (the vertical direction in FIG. 1). The n gate signal lines GL1 to GLn are arranged parallel to one another, and the 3 m source signal lines SLR1 to SLBm are arranged parallel to one another in a direction orthogonal to the gate signal lines GL1 to GLn. The 3 m display elements 15 arranged in the same row are commonly connected to any of the n gate signal lines GL1 to GLn. The n display elements 15 arranged in the same column are commonly connected to any of the 3 m source signal lines SLR1 to SLBm. The n gate signal lines GL1 to GLn are also referred to as scanning signal lines, the 3 m source signal lines SLR1 to SLBm are also referred to as sub data signal lines, and a video signal line and a source signal line corresponding to the video signal line are also referred to as data signal lines.

Three display elements 15 arranged successively in the row direction in the display unit 10 are provided with color filters (not illustrated) which transmit light of different colors. These three display elements 15 function as a red sub-pixel, a green sub-pixel, and a blue sub-pixel, and three display elements form one pixel. In FIG. 1, the display elements 15 denoted by R, G, and B function as a red sub-pixel, a green sub-pixel, and a blue sub-pixel, respectively.

The display control circuit 20 controls the operation of a liquid crystal display device. More specifically, the display control circuit 20 receives a video signal DAT and a timing signal group TG of a horizontal synchronization signal, a vertical synchronization signal, and the like sent from an external source, and outputs, to the source driver 40, a digital video signal DV (hereinafter, simply referred to as "video signal"), a source start pulse signal SSP for controlling video image display in the display unit 10, a source clock signal SCK, and a latch strobe signal LS. The display control circuit 20 also outputs, to the gate driver 30, a gate start pulse signal GSP as a scanning start signal and a gate clock signal GCK. The display control circuit 20 also outputs, to the multiplexer 50, selection signals ASWR1 to ASWRm, ASWG1 to ASWGm, and ASWB1 to ASWBm (hereinafter, simply referred to as "ASWR1 to ASWBm") for selecting the source signal lines SLR1 to SLBm outputting voltage according to the video signal, and outputs, to the charge matching circuit 60, a matching instruction signal MA for performing charge sharing between two adjacent source signal lines.

The gate driver 30 sequentially selects one gate signal line from the n gate signal lines GL1 to GLn based on the gate start pulse signal GSP and the gate clock signal GCK, and supplies a high level scanning signal to the selected gate signal line. Consequently, the selected gate signal line is activated, and the 3 m display elements 15 arranged in the same row are collectively selected out of the display elements 15 arranged in the display unit 10.

The source driver 40 applies, in a time-division manner, a voltage according to any of red, green, and blue video signals to the m video signal lines VSL1 to VSLm based on the source start pulse signal SSP, the source clock signal SCK, and the latch strobe signal LS. To perform dot-reversal driving, the source driver 40 reverses the polarity of the voltage according to the video signal which is applied to the source signal line from positive to negative, or from negative to positive every frame period, every horizontal period, and every source signal line.

The multiplexer 50 applies voltages according to the video signals of the respective colors to corresponding source signal lines based on the selection signals ASWR1 to ASWBm supplied from the display control circuit 20. Specifically, when the selection signals ASWR1 to ASWRm become high level, the multiplexer 50 simultaneously applies the voltage according to the red video signal supplied to the video signal lines VSL1 to VSLm to the source signal lines SLR1 to SLRm. Next, when the selection signals ASWG1 to ASWGm become high level, the multiplexer 50 applies the voltage according to the green video signal supplied to the video signal lines VSL1 to VSLm to the source signal lines SLG1 to SLGm. Next, when the selection signals ASWB1 to ASWBm become high level, the multiplexer 50 simultaneously applies the voltage according to the blue video signal supplied to the video signal lines VSL1 to VSLm to the source signal lines SLB1 to SLBm.

Figure 2:
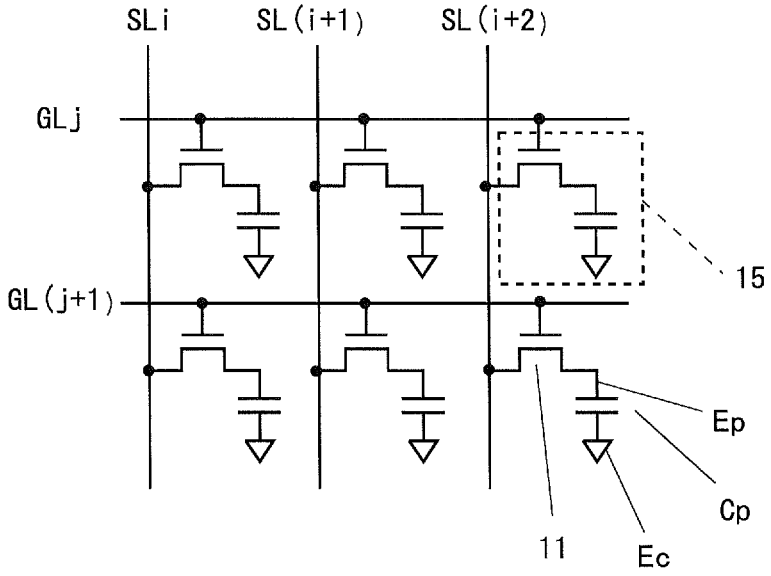
FIG. 2 is a diagram illustrating a configuration of display elements arranged in a display unit in the liquid crystal display device shown in FIG. 1.

FIG. 2 is a diagram illustrating the configuration of the display element 15 arranged in the display unit 10. As illustrated in FIG. 2, the display element 15 includes an N-channel thin film transistor (hereinafter, abbreviated as "TFT") 11, whose gate terminal is connected to the gate signal line GLj passing a corresponding intersection and whose source terminal is connected to the source signal line SLi passing the intersection, a pixel electrode Ep connected to the drain terminal of the TFT 11, an opposed electrode Ec provided commonly to each display element 15, and a liquid crystal layer (not illustrated) sandwiched between the pixel electrode Ep and the opposed electrode Ec in each display element 15. The liquid crystal capacitance formed by the pixel electrode Ep and the opposed electrode Ec is a pixel capacitance Cp. In many cases, the pixel capacitance Cp also has an auxiliary capacitance arranged in parallel to the liquid crystal capacitance so that the video signal can be stored reliably. Since the auxiliary capacitance is not directly related to the present invention, the present specification will be described on the assumption that the pixel capacitance Cp is made only by the liquid crystal capacitance. TFT 11 may be a P-channel TFT.

In the display element 15 connected to the j-th gate signal line GLj and the i-th source signal line SLi, while the j-th gate signal line GLj is activated, the i-th source signal line SLi and the pixel electrode Ep are electrically connected, and the video signal is supplied to the pixel capacitance Cp. Thereafter, when the j-th gate signal line GLj is made inactive, the video signal supplied to the i-th source signal line SLi is stored in the pixel capacitance Cp. The transmittance of light in the display element 15 changes according to the video signal stored in the capacitance in the display element 15. Therefore, by storing the video signal in the pixel capacitance Cp in each display element 15, a desired screen can be displayed in the display unit 10.

The charge matching circuit 60 is connected to two adjacent source signal lines via discharge circuits (not illustrated). Consequently, the charge matching circuit 60 includes 3 m/2 discharge circuits. For example, the source signal lines SLR1 and SLG1 are connected via a discharge circuit, and the source signal lines SLB1 and SLR2 are connected via a discharge circuit. A positive voltage is applied to one of the two source signal lines connected via a discharge circuit and a negative voltage is applied to the other source signal line, and thereafter, the matching instruction signal MA is supplied from the display control circuit 20 to the discharge circuit, thereby making the discharge circuit conductive. As a result, the two source signal lines are short-circuited, and charge sharing is performed between the two source signal lines, so that the voltage of each source signal line becomes 0V. The voltages applied to the source signal lines are referred to as a positive reset voltage and a negative reset voltage.

1.2 Configuration of Multiplexer and Charge Matching Circuit

Figure 3:
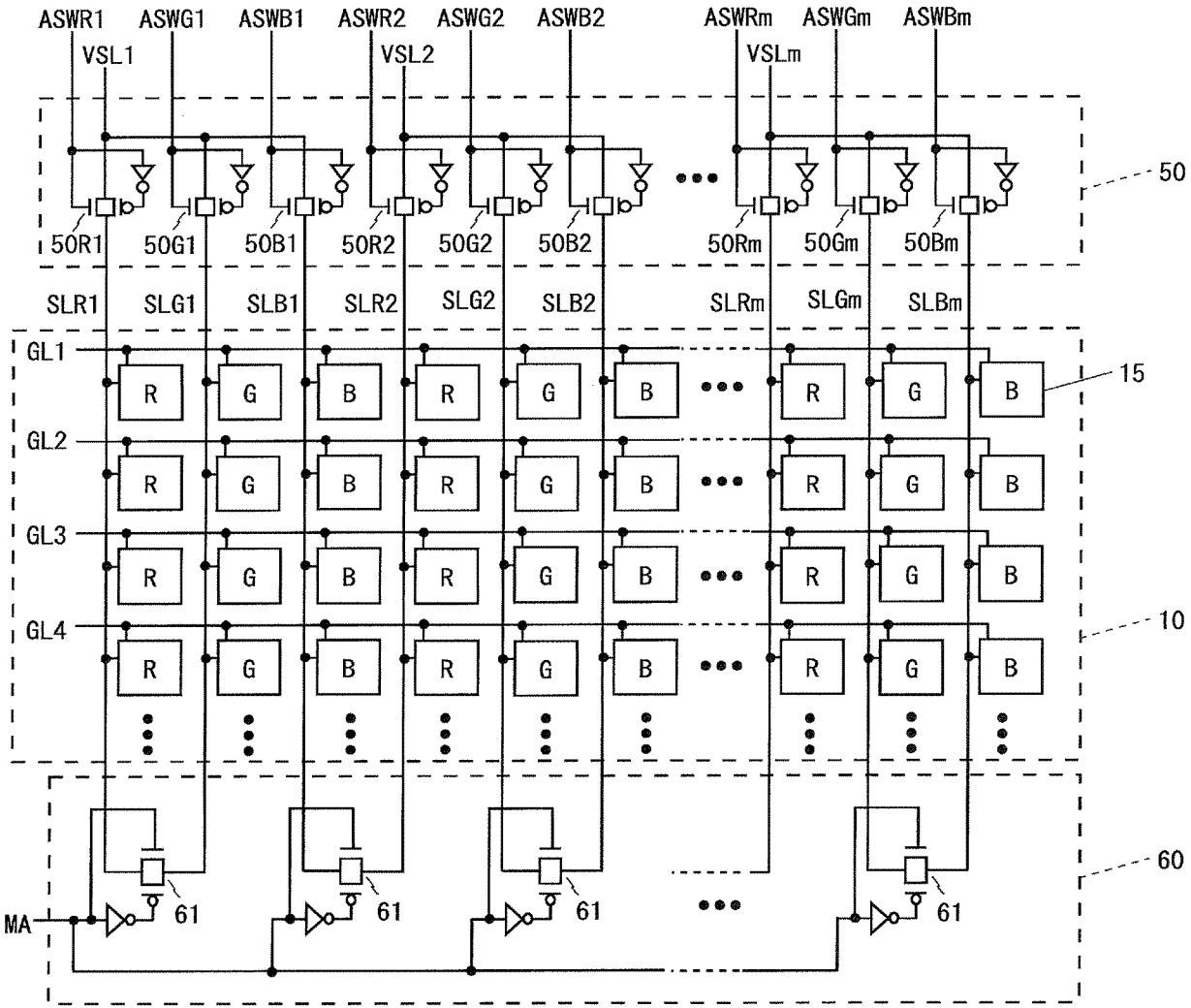
FIG. 3 is a diagram illustrating a configuration of a display unit including a multiplexer and a matching circuit in the liquid crystal display device shown in FIG. 1.

FIG. 3 is a diagram illustrating the configuration of the display unit 10 including the multiplexer 50 and the charge matching circuit 60. First, the multiplexer 50 will be described. The multiplexer 50 is configured by 3 m selection circuits 50R1 to 50Rm, 50G1 to 50Gm, and 50B1 to 50Gm (hereinafter, simply referred to as "50R1 to 50Bm") connected to the 3 m source signal lines SLR1 to SLBm.

The selection circuits 50R1 to 50Bm are configured by CMOS (Complementary Metal Oxide Semiconductor) analog switches (hereinafter, simply referred to as "analog switches") and each analog switch is configured by an N-channel TFT, a P-channel TFT, and an inverter (logic inverter circuit). The drain terminals of the N-channel TFT and the P-channel TFT are connected to each of the video signal lines VSL1 to VSLm, and the source terminals are connected to each of the source signal lines SLR1 to SLBm. The gate terminal of the N-channel TFT receives a selection signal from the display control circuit 20, and the gate terminal of the P-channel TFT receives a signal obtained by inverting the logic of the selection signal via the inverter. Therefore, the selection circuits 50R1 to 50Bm to which the high level selection signals ASWG1 to ASWRm are supplied enter an on state, and the drain terminal and the source terminal enter a conductive state.

Each of the video signal lines VSL1 to VSLm is connected to three signal lines of the source signal lines SLR1 to SLBm via the selection circuits 50R1 to 50Rm. First, when the selection signals ASWG1 to ASWRm are supplied to the selection circuits 50R1 to 50Rm, respectively, the selection circuits 50R1 to 50Rm enter the conductive state, and red video signals are supplied from the video signal lines VSL1 to VSLm to the source signal lines SLR1 to SLRm. Next, when the selection signals ASWG1 to ASWGm are supplied, the selection circuits 50G1 to 50Gm enter the conductive state, and green video signals are supplied from the video signal lines VSL1 to VSLm to the source signal lines SLG1 to SLGm. When the selection signals ASWB1 to ASWBm are supplied, the selection circuits 50B1 to 50Bm enter the conductive state, and blue video signals are supplied from the video signal lines VSL1 to VSLm to the source signal lines SLB1 to SLBm. In this manner, the video signals of corresponding colors are respectively supplied to the source signal lines SLR1 to SLBm in the one horizontal period.

Next, the charge matching circuit 60 will be described. The charge matching circuit 60 is configured by the 3 m/2 discharge circuits 61. The discharge circuits 61 are also configured by analog switches and each analog switch is configured by an N-channel TFT, a P-channel TFT, and an inverter. The gate terminal of the N-channel TFT is directly connected to the display control circuit 20, and the gate terminal of the P-channel TFT is connected to the display control circuit 20 via an inverter (logic inverter circuit). The drain terminal of each TFT is connected to one of two adjacent source signal lines, and the source terminal is connected to the other source signal line. When the high level matching instruction signal MA is supplied from the display control circuit 20 to the charge matching circuit 60, both of the N-channel TFT and the P-channel TFT enter the on state. Consequently, all of the discharge circuits 61 enter the conductive state, so that pairs of the source signal lines connected via the discharge circuits 61 are short-circuited. As a result, charge sharing is performed between the source signal line to which +5V is applied and the source signal line to which −5V is applied, and the voltages of the source signal lines SLR1 to SLBm become 0V.

In the above description, it is assumed that the selection circuits 50R1 to 50Bm and the discharge circuits 61 are configured by analog switches. However, both or one of the selection circuits 50R1 to 50Bm and the discharge circuits 61 may be configured by the N-channel or P-channel TFT. Also in the case of using the single-channel TFTs as described above, the selection circuits 50R1 to 50Bm and the discharge circuits 61 can have a function similar to that in the case of being configured by the analog switches. The same is applied to the case of liquid crystal display devices according to second and third embodiments which will be described later.

1.3 Driving Method of Liquid Crystal Display Device

Figure 4:
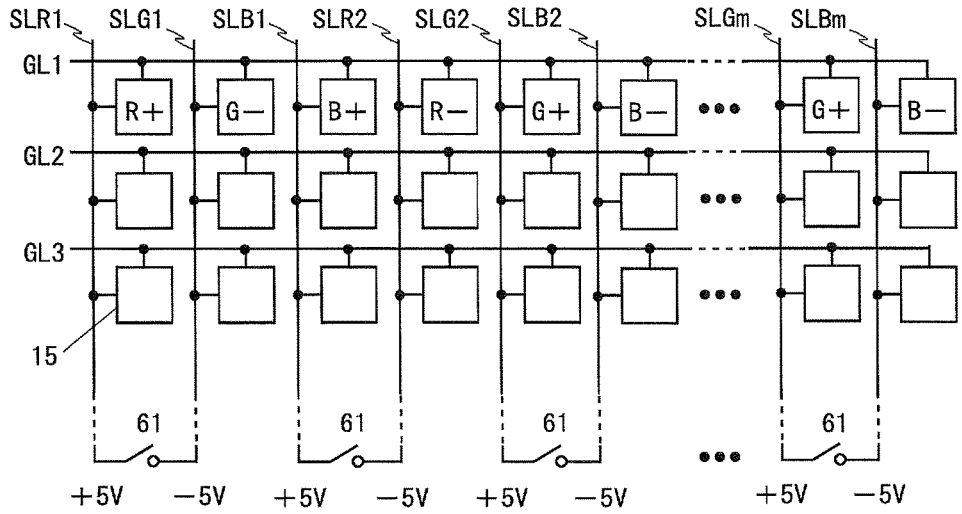
FIGS. 4(A) and 4(B) are diagrams illustrating source signal lines to which voltage is applied in each horizontal period by a dot-reversal driving method in the liquid crystal display device shown in FIG. 1. More specifically.
Figure 4:
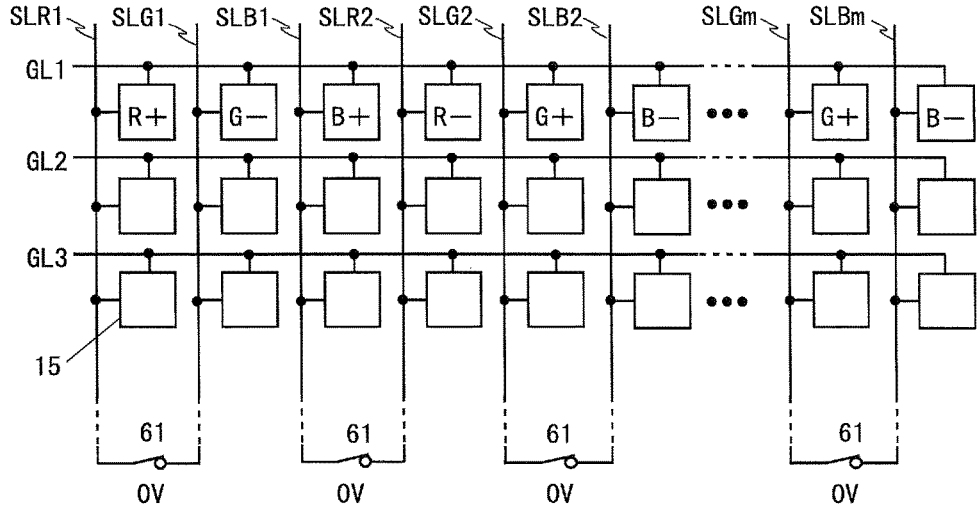
Figure 5:
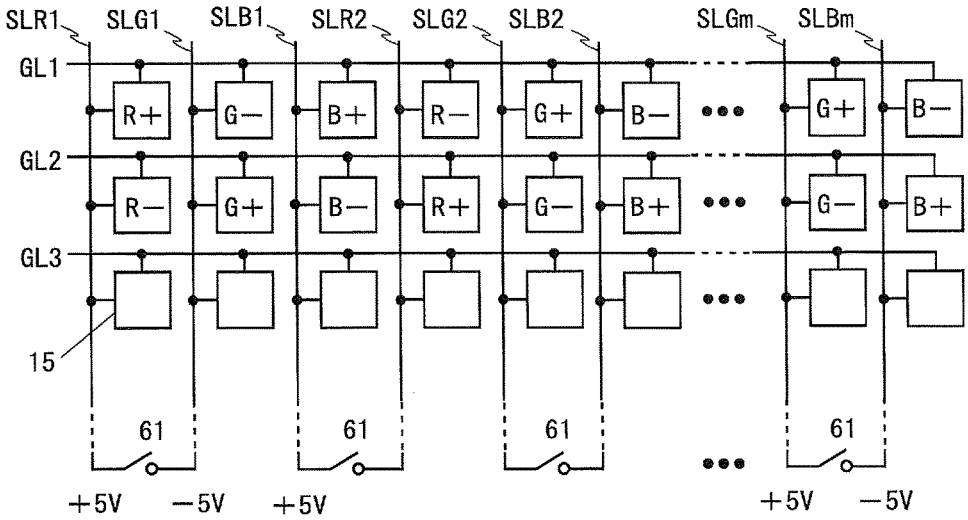
FIGS. 5(A) and 5(B) are diagrams illustrating the source signal lines to which voltage is applied in each horizontal period by the dot-reversal driving method in the liquid crystal display device shown in FIG. 1. More specifically.
Figure 5:
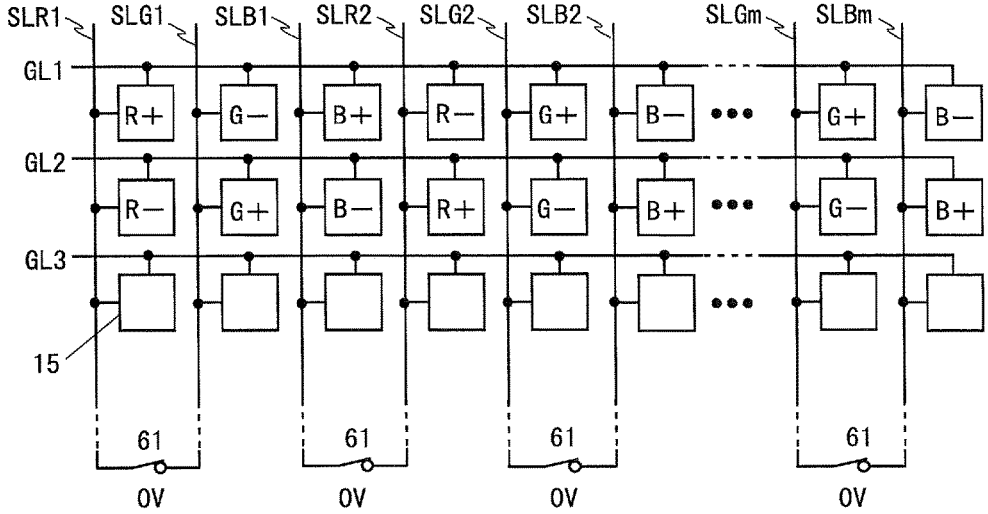

FIGS. 4(A) and 4(B) are diagrams illustrating the source signal lines to which voltage is applied in each horizontal period by the dot-reversal driving method. More specifically, FIG. 4(A) is a diagram illustrating source signal lines in which video signals are stored in sub-pixels of the respective colors in a first horizontal period 1H(1) and to which reset voltage is thereafter applied. FIG. 4(B) is a diagram illustrating the source signal lines short-circuited at the beginning of the second horizontal period 1H(2). FIGS. 5(A) and 5(B) are diagrams illustrating the source signal lines to which voltage is applied in each horizontal period by the dot-reversal driving method. More specifically, FIG. 5(A) is a diagram illustrating source signal lines in which video signals are stored in sub-pixels of the respective colors in a second horizontal period 1H(2) and to which reset voltage is thereafter applied. FIG. 5(B) is a diagram illustrating the source signal lines short-circuited at the beginning of a third horizontal period 1H(3).

In the dot-reversal driving method, as illustrated in FIG. 4(A), in the first horizontal period 1H(1), a positive red video signal and a positive blue video signal are respectively stored in red sub-pixels and blue sub-pixels in the first row connected to any of the source signal lines SLR1 to SLRm or the source signal lines SLB1 and connected to the gate signal line GL1. A negative green video signal is stored in green sub-pixels in the first row connected to any of the source signal lines SLG1 to SLGm and connected to the gate signal line GL1. Thereafter, a scan signal applied to the gate signal line GL1 is changed from the high level to the low level, +5V as a positive reset voltage is applied to the source signal lines SLR1 to SLRm and the source signal lines SLB1 to SLBm, and −5V as a negative reset voltage is applied to the source signal lines SLG1 to SLGm. Consequently, regardless of the voltage of the video signal, the voltages of the source signal lines SLR1 to SLRm and SLB1 to SLBm become +5V, and the voltages of the source signal lines SLG1 to SLGm become −5V. Note that +5V is the maximum voltage among positive voltages according to the video signal, and −5V is the minimum voltage (the absolute value is the maximum voltage) among negative voltages according to the video signal.

Next, as illustrated in FIG. 4(B), by making all of the discharge circuits 61 enter the conductive state at the beginning of the second horizontal period 1H(2), pairs of signal lines each configured by the source signal line to which +5V is applied and the source signal line to which −5V is applied are short-circuited. Consequently, charge sharing is performed between the two source signal lines, and the voltages of the source signal lines SLR1 to SLBm become 0V.

Thereafter, as illustrated in FIG. 5(A), a negative red video signal and a negative blue video signal are respectively stored in red sub-pixels and blue sub-pixels in the second row connected to any of the source signal lines SLR1 to SLRm or the source signal lines SLB1 and connected to the gate signal line GL2. A positive green video signal is stored in green sub-pixels in the second row connected to any of the source signal lines SLG1 to SLGm and connected to the gate signal line GL2. Thereafter, a scan signal applied to the gate signal line GL2 is changed from the high level to the low level, +5V is applied to the source signal lines SLG1 to SLGm, and −5V is applied to the source signal lines SLR1 to SLRm and the source signal lines SLB1 to SLBm. Consequently, regardless of the voltage of the video signal, the voltages of the source signal lines SLG1 to SLGm become +5V, and the voltages of the source signal lines SLR1 to SLRm and SLB1 to SLBm become −5V.

Next, as illustrated in FIG. 5(B), by making all of the discharge circuits 61 enter the conductive state at the beginning of the third horizontal period 1H(3), pairs of signal lines each configured by the source signal line to which +5V is applied and the source signal line to which −5V is applied are short-circuited. Consequently, charge sharing is performed between the two source signal lines, and the voltages of the source signal lines SLR1 to SLBm become 0V again.

Similarly, the video signals are supplied to the source signal lines and stored in the sub-pixels every horizontal period until the n-th horizontal period 1H(n). Thereafter, +5V or −5V is applied to each of the source signal lines, and pairs of signal lines each configured by the source signal line to which +5V is applied and the source signal line to which −5V is applied are short-circuited. The operation of supplying the next video signal to the source signal lines SLR1 to SLBm in which the voltages have become 0V as described above is repeated.

In the present embodiment, the reset voltages are +5V and −5V as the maximum value and the minimum value of the voltage according to the video signal. However, the reset voltage is not limited to those voltages and may be, for example, an intermediate voltage on the positive polarity side and an intermediate voltage on the negative polarity side such as +3V and −3V. Also in this case, the absolute value of the reset voltage is smaller than the absolute value of the maximum and minimum values of the voltage according to the video signal, so that the power consumption of a driver video amplifier for reversing the polarity of reset voltage, provided in the source driver 40, can be reduced.

The absolute value of the reset voltage may be, for example, a voltage larger than the absolute value of the maximum value and the minimum value of the voltage according to the video signal such as +7V and −7V. In this case, when the voltages are used as the power supply of a liquid crystal display device, the voltages can be used as the reset voltages. Consequently, it is not necessary to newly provide a circuit for generating the reset voltage. Therefore, the manufacture cost of the liquid crystal display device can be reduced.

Further, the reset voltages are the positive voltage and the negative voltage, and as described above, their absolute values need to be equal to each other. Consequently, by short-circuiting the source signal line to which the positive reset voltage is applied and the source signal line to which the negative reset voltage is applied, the voltage of each source signal line becomes 0V by charge sharing which will be described later. Note that the above description on the reset voltage is applied not only to the liquid crystal display device according to the present embodiment but also to liquid crystal display devices according to second and third embodiments which will be described later.

In an odd-numbered horizontal period and an even-numbered horizontal period, the polarities of voltages according to video signals of respective colors applied to source signal lines may be opposite to the polarities illustrated in FIGS. 4(A) to 5(B).

Figure 6:
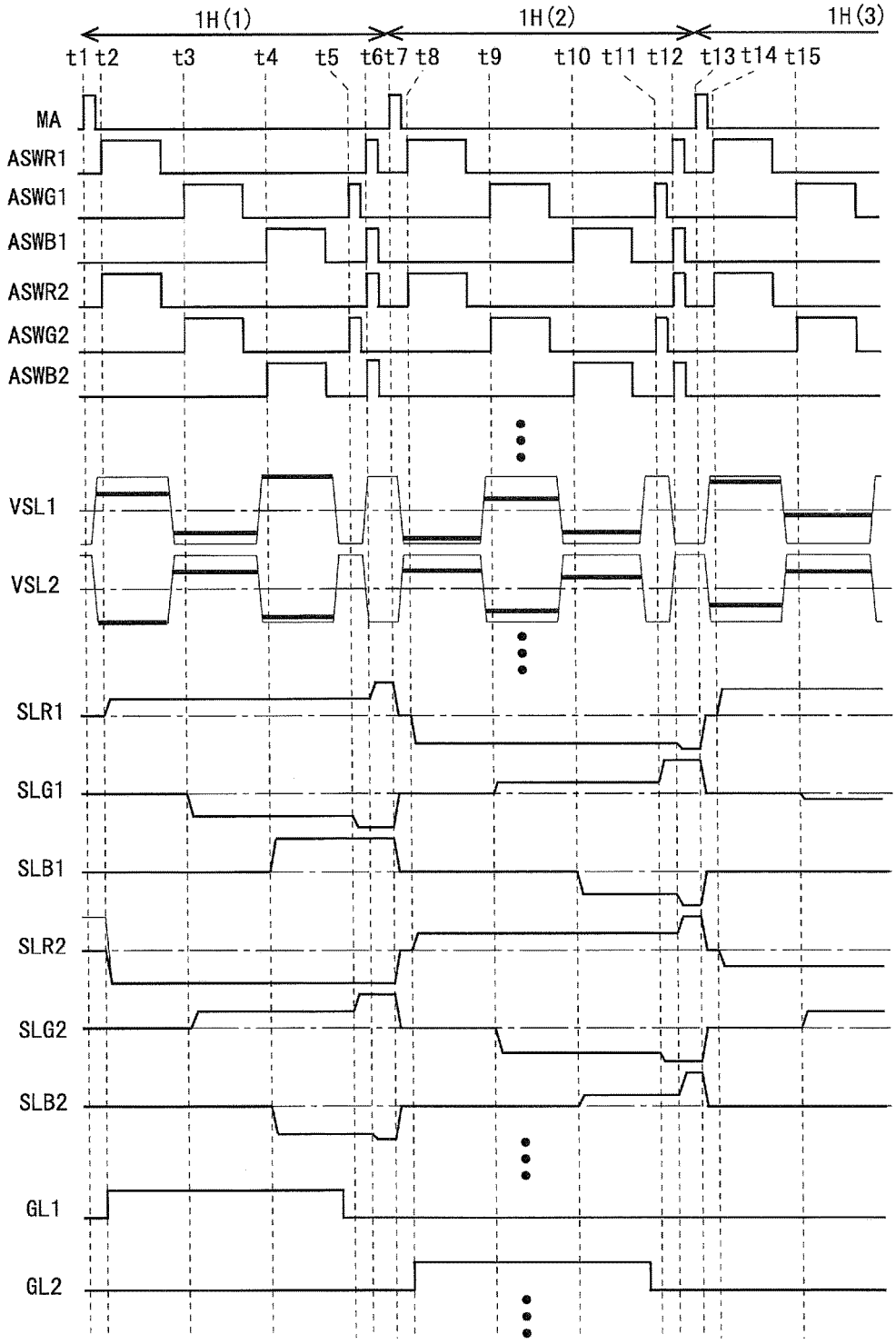
FIG. 6 is a timing chart illustrating operations of the liquid crystal display device shown in FIG. 1.

FIG. 6 is a timing chart illustrating the operation of the liquid crystal display device. First, the first horizontal period 1H(1) will be described. As illustrated in FIG. 6, at time t1, the high level matching instruction signal MA is simultaneously supplied to all of the discharge circuits 61 in the charge matching circuit 60. Accordingly, all of the discharge circuits 61 enter the conductive state, and pairs of the source signal lines connected via the discharge circuits are short-circuited. As a result, charge sharing is performed between the short-circuited source signal lines, and the voltages of the source signal lines SLR1 to SLBm become 0V.

Next, at time t2, the high level selection signals ASWR1 to ASWRm are respectively supplied to the selection circuits 50R1 to 50Rm connected to the source signal lines SLR1 to SLRm to which the display elements 15 serving as the red sub-pixels are connected. Consequently, the selection circuits 50R1 to 50Rm enter the conductive state, and the positive red video signal which is output from the source driver 40 to the video signal lines VSL1 to VSLm is supplied to the source signal lines SLR1 to SLRm via the selection circuits 50R1 to 50Rm.

Next, the selection signals ASWR1 to ASWRm become the low level, and at time t3, the high level selection signals ASWG1 to ASWGm are respectively supplied to the gate terminals of the selection circuits 50G1 to 50Gm connected to the source signal lines SLG1 to SLGm to which the display elements 15 serving as green sub-pixels are connected. Consequently, the selection circuits 50G1 to 50Gm enter the conductive state, and the negative green video signal which is output from the source driver 40 to the video signal lines VSL1 to VSLm is supplied to the source signal lines SLG1 to SLGm via the selection circuits 50G1 to 50Gm.

Subsequently, the selection circuits ASWG1 to ASWGm become the low level, and at time t4, the high level selection signals ASWB1 to ASWBm are respectively supplied to the gate terminals of the selection circuits 50B1 to 50Bm connected to the source signal lines SLB1 to SLBm to which the display elements 15 serving as blue sub-pixels are connected. Consequently, the selection circuits 50B1 to 50Bm enter the conductive state, and the positive blue video signal which is output from the source driver 40 to the video signal lines VSL1 to VSLm is supplied to the source signal lines SLB1 to SLBm via the selection circuits 50B1 to 50Bm.

In a period after the voltage according to the red video signal is applied to the source signal lines SLR1 to SLRm until the voltage according to the blue video signal is applied to the source signal lines SLB1 to SLBm, the high level scanning signal is applied to the gate signal line GL1. Consequently, a positive red video signal is supplied to a pixel capacitance Cp in a red sub-pixel connected to the gate signal line GL1, a negative green video signal is supplied to a pixel capacitance Cp of a green sub-pixel, and a positive blue video signal is supplied to a pixel capacitance Cp of a blue sub-pixel. When the blue video signal is supplied to the blue sub-pixel, the scanning signal of the gate signal line GL1 is set to the low level. Therefore, a TFT 11 in each sub-pixel becomes the off state, the red sub-pixel and the blue sub-pixel connected to the gate signal line GL1 store the positive video signal, and the green sub-pixel stores the negative video signal. The positive video signal is supplied to the source signal lines SLR1 to SLRm and SLB1 to SLBm, and the negative video signal is supplied to the source signal lines SLG1 to SLGm.

Next, at time t5, to apply −5V to the source signal lines SLG1 to SLGm to which the negative video signal is supplied, the high level selection signals ASWG1 to ASWGm are simultaneously supplied to the selection circuits 50G1 to 50Gm. Consequently, the selection circuits 50G1 to 50Gm enter the conductive state, and −5V is applied to each of the source signal lines SLG1 to SLGm. As a result, the voltages of the source signal lines SLG1 to SLGm become −5V regardless of the voltage of the green video signal applied at time t3.

Next, at time t6, to apply +5V to the source signal lines SLR1 to SLRm and SLB1 to SLBm to which the positive video signal is supplied, the high level selection signals ASWR1 to ASWRm and ASWB1 to ASWBm are respectively supplied to the selection circuits 50R1 to 50Rm and 50B1 to 50Bm. Consequently, the selection circuits 50R1 to 50Rm and 50B1 to 50Bm enter the conductive state, and +5V is applied to each of the source signal lines SLR1 to SLRm and SLB1 to SLBm. As a result, the voltages of the source signal line SLR1 to SLRm and SLB1 to SLBm become +5V regardless of the voltage of the red or blue video signal applied at time t2 or t4.

Next, the second horizontal period 1H(2) will be described. At time t7, the high level matching instruction signal MA is simultaneously supplied to the discharge circuits 61. Accordingly, all of the discharge circuits 61 enter the conductive state, and pairs of the source signal lines connected via the discharge circuits 61 are short-circuited. As a result, charge sharing is performed between the short-circuited source signal lines, and the voltages of the source signal lines SLR1 to SLBm become 0V.

In the second horizontal period 1H(2), a video signal obtained by reversing the polarity of the video signal applied in the first horizontal period 1H(1) is supplied to the source signal lines SLR1 to SLBm. Specifically, at time t8, a high level scanning signal is applied to the gate signal line GL2 to activate the gate signal line GL2, the selection signals ASWR1 to ASWRm are set to the high level, and the negative red video signal is supplied to the source signal lines SLR1 to SLRm. At time t9, the selection signals ASWG1 to ASWGm are set to the high level, and the positive green video signal is supplied to the source signal lines SLG1 to SLGm. At time t10, the selection signals ASWB1 to ASWBm are set to the high level, and the negative blue video signal is supplied to the source signal lines SLB1 to SLBm. Thereafter, the scanning signal applied to the gate signal line GL2 is set to the low level. Consequently, the TFT 11 in each sub-pixel becomes the off state, the red sub-pixel and the blue sub-pixel connected to the gate signal line GL2 store the negative video signal, and the green sub-pixel stores the positive video signal. The negative video signal is supplied to the source signal lines SLR1 to SLRm and SLB1 to SLBm, and the positive video signal is supplied to the source signal lines SLG1 to SLGm.

Next, to apply +5V to the source signal lines SLG1 to SLGm to which the positive video signal is supplied, at time t11, the high level selection signals ASWG1 to ASWGm are simultaneously supplied to the corresponding selection circuits 50G1 to 50Gm, respectively. Consequently, the selection circuits 50G1 to 50Gm enter the conductive state, and +5V is applied to each of the source signal lines SLG1 to SLGm. As a result, the voltages of the source signal lines SLG1 to SLGm become +5V regardless of the voltage of the green video signal applied at time t9.

Next, to apply −5V to the source signal lines SLR1 to SLRm and SLB1 to SLBm to which the negative video signal is supplied, at time t12, the high level selection signals ASWR1 to ASWRm and ASWB1 to ASWBm are simultaneously supplied to the corresponding selection circuits 50R1 to 50Rm and 50B1 to 50Bm, respectively. Consequently, the selection circuits 50R1 to 50Rm and 50B1 to 50Bm enter the conductive state, and −5V is applied to the source signal lines SLR1 to SLRm and SLB1 to SLBm. As a result, the voltages of the source signal lines SLR1 to SLRm and SLB1 to SLBm become −5V regardless of the voltage of the red or blue video signal applied at time t8 or t10.

Next, the third horizontal period 1H(3) will be described. At time t13, the high level matching instruction signal MA is simultaneously supplied to the discharge circuits 61. Accordingly, all of the discharge circuits 61 enter the conductive state, and pairs of the source signal lines connected via the discharge circuits 61 are short-circuited. As a result, charge sharing is performed between the short-circuited source signal lines, and the voltages of the source signal lines SLR1 to SLBm become 0V. In this manner, the next video signal is applied to the source signal lines SLR1 to SLBm in which the voltages have become 0V as described above.

Hereinafter, similarly, in odd-numbered horizontal periods, charge sharing is performed as in the first horizontal period 1H(1), the voltages of the source signal lines SLR1 to SLRm become 0V every horizontal period. In even-numbered horizontal periods, charge sharing is performed as in the second horizontal period 1H(2), and the voltages of the source signal lines SLR1 to SLRm become 0V every horizontal period.

In the above description, the reset voltages are voltages whose absolute values are equal to and whose polarities are different such as +5V and −5V. The voltages whose absolute values are equal to and whose polarities are different include, for example, voltages such as +5.1V and −5.2V which become values close to 0V when the source signal lines are short-circuited and exert substantially the same effect as that of the present embodiment. The same is applied to the case of liquid crystal display devices according to second and third embodiments which will be described later.

1.4 Effects

In the liquid crystal display device which is dot-reversal driven according to the present embodiment, by short-circuiting the source signal line to which +5V is applied and the source signal line to which −5V is applied, charge sharing is performed between the source signal lines and the voltages of the source signal lines become 0V. In the case of applying a voltage according to the video signal of each color to such a source signal line in the next horizontal period, the voltage of the source signal line becomes voltage according to a video signal without being influenced by the video signal applied in the immediately preceding horizontal period. Consequently, such a liquid crystal display device can display a color video image having reduced display unevenness and high uniformity.

As the selection circuits 50R1 to 50Bm, analog switches whose power consumption at the time of driving is small and having high current drivability are used. Therefore, even if characteristic variations are present in thin film transistors constituting an analog switch, the source signal lines SLR1 to SLBm can be charged in a short time, so that display unevenness caused by insufficient charging in the source signal lines SLR1 to SLBm can be reduced.

Since it is sufficient to arrange the discharge circuits 61 so as to connect two adjacent source signal lines, designing of the liquid crystal display device can be performed easily.

2. Second Embodiment

2.1 Configuration of Liquid Crystal Display Device

Since a configuration of a liquid crystal display device according to a second embodiment of the present invention is the same as that of the liquid crystal display device according to the first embodiment illustrated in FIG. 1, diagrams and descriptions thereof are omitted. Different from the liquid crystal display device of FIG. 1, the liquid crystal display device according to the present embodiment is column-reversal-driven.

Figure 7:
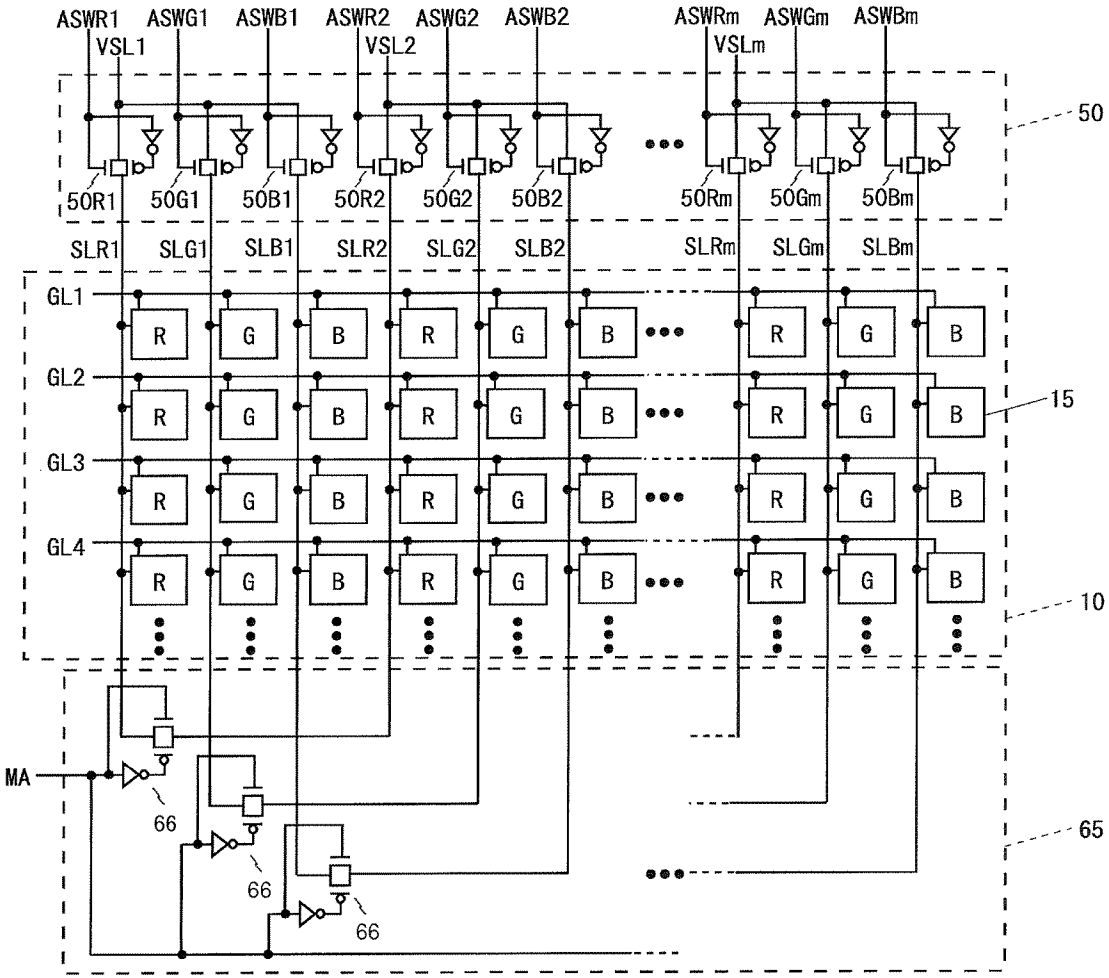
FIG. 7 is a diagram illustrating a configuration of a display unit including a multiplexer and a charge matching circuit included in a liquid crystal display device according to a second embodiment.

FIG. 7 is a diagram illustrating the configuration of the display unit 10 including the multiplexer 50 and a charge matching circuit 65 included in the liquid crystal display device according to the present embodiment. Since the configuration of the multiplexer 50 illustrated in FIG. 7 is the same as that of the multiplexer 50 illustrated in FIG. 3, the same reference numerals as those of FIG. 3 are denoted to corresponding components, and descriptions thereof will not be repeated.

Next, the charge matching circuit 65 will be described. Similarly to the charge matching circuit 60 illustrated in FIG. 3, the charge matching circuit 65 includes 3 m/2 discharge circuits 66 configured by analog switches. The gate terminal of the N-channel TFT is directly connected to the display control circuit 20, and the gate terminal of the P-channel TFT is connected to the display control circuit 20 via an inverter. When the high level matching instruction signal MA is supplied from the display control circuit 20 to the discharge circuit 66, both of N-channel TFT and the P-channel TFT enter the on state. Consequently, all of the discharge circuits 61 enter the conductive state. The drain terminal of each TFT is connected one of the two source signal lines which supply the video signal of the same color in adjacent pixels, and the source terminal is connected to the other source signal line.

For example, in the first horizontal period 1H(1), +5V is applied to the source signal line SLR1 to which the positive red video signal is applied, and −5V is applied to the source signal line SLR2 to which the negative red video signal is applied. Since the source signal line SLR1 and the source signal line SLR2 are connected to each other via the discharge circuit 66, when the high level matching instruction signal MA is supplied from the display control circuit 20 to the discharge circuit 66, all of the discharge circuits 66 enter the conductive state, and the source signal line SLR1 and the source signal line SLR2 are short-circuited. As a result, both of the voltage of the source signal line SLR1 and the voltage of the source signal line SLR2 become 0V.

Similarly, the source signal line SLG1 and the source signal line SLG2 to which the green video signal is supplied are connected via the discharge circuit 66, and the source signal line SLB1 and the source signal line SLB2 to which the blue video signal is supplied are connected via the discharge circuit 66. Consequently, when the high level matching instruction signal MA is supplied, all of the discharge circuits 66 enter the conductive state. As a result, the source signal line SLG1 and the source signal line SLG2 are short-circuited, the source signal line SLB1 and the source signal line SLB2 are short-circuited, and all of their voltages become 0V. In this manner, all of the voltages of the source signal lines SLR1 to SLBm become 0V.

Also in the subsequent one horizontal period, the polarities of the reset voltages applied to the source signal lines SLR1 to SLBm are the same as those in the case of the first horizontal period 1H(1). Therefore, as in the case of the first horizontal period 1H(1), the voltages of the source signal lines SLR1 to SLBm become 0V every horizontal period.

2.2 Driving Method of Liquid Crystal Display Device

Figure 8:
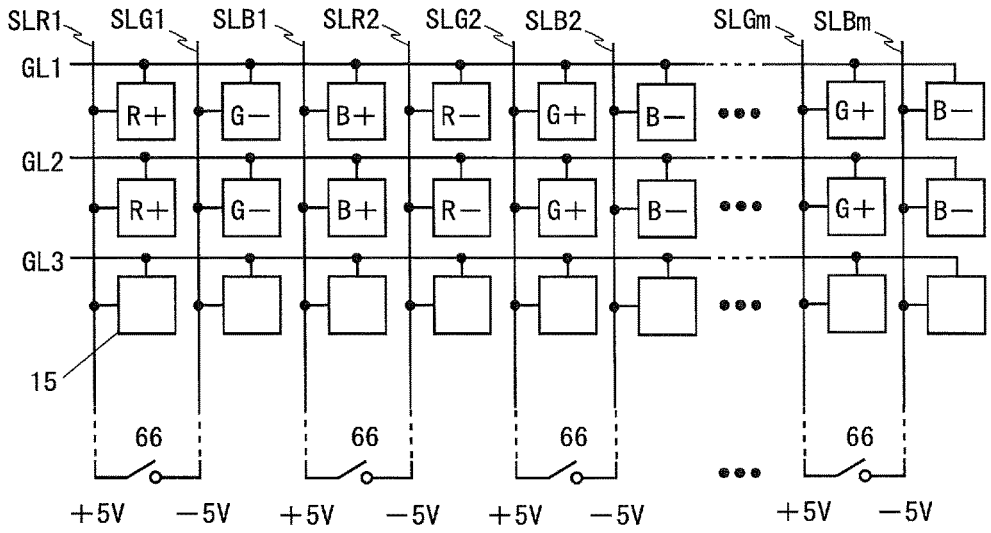
FIGS. 8(A) and 8(B) are diagrams illustrating source signal lines to which voltage is applied in each horizontal period by a column-reversal driving method in the liquid crystal display device according to the second embodiment. More specifically.
Figure 8:
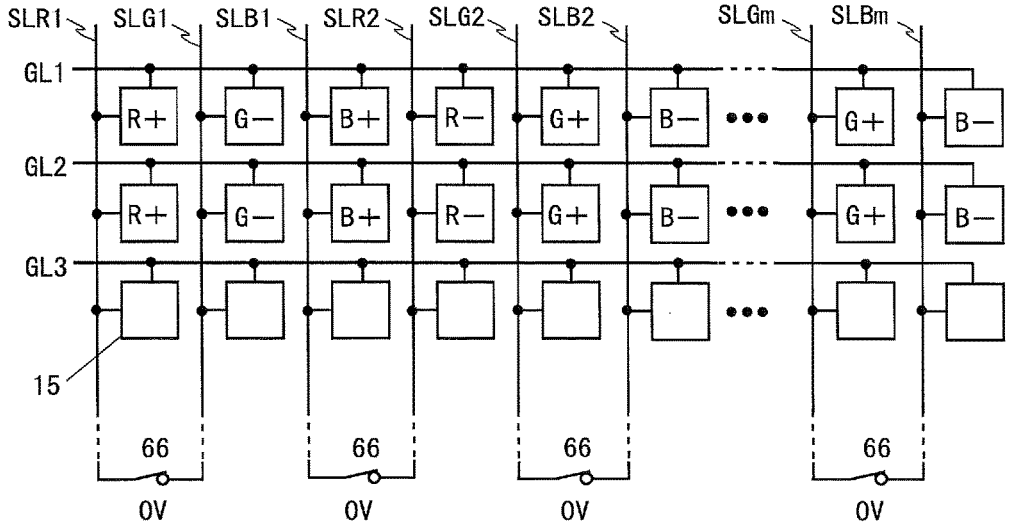

Since a diagram illustrating source signal lines which store video signals in sub-pixels of respective colors in the first horizontal period 1H(1) and to which reset voltage is thereafter applied, and a diagram illustrating the source signal lines short-circuited at the beginning of the second horizontal period 1H(2) are the same as FIGS. 4(A) and 4(B), respectively, the diagrams are not illustrated. FIGS. 8(A) and 8(B) are diagrams illustrating source signal lines to which voltage is applied in horizontal periods by the column-reversal driving method. More specifically, FIG. 8(A) is a diagram illustrating source signal lines which store video signals in sub-pixels of respective colors in the second horizontal period 1H(2) and to which reset voltage is thereafter applied, and FIG. 8(B) is a diagram illustrating the source signal lines short-circuited at the beginning of the third horizontal period 1H(3).

In the column-reversal driving method, as in the case illustrated in FIG. 4(A), first, in the first horizontal period 1H(1), a positive red video signal and a positive blue video signal are respectively stored in red sub-pixels and blue sub-pixels in the first row connected to any of the source signal lines SLR1 to SLRm or the source signal lines SLB1 and connected to the gate signal line GL1. A negative green video signal is stored in green sub-pixels in the first row connected to any of the source signal lines SLG1 to SLGm and connected to the gate signal line GL1. Thereafter, +5V is applied to the source signal lines SLR1 to SLRm and the source signal lines SLB1 to SLBm, and −5V is applied to the source signal lines SLG1 to SLGm. Consequently, regardless of the voltage of the video signal, the voltages of the source signal lines SLR1 to SLRm and SLB1 to SLBm become +5V, and the voltages of the source signal lines SLG1 to SLGm become −5V.

Next, as in the case illustrated in FIG. 4(B), by making all of the discharge circuits 66 enter the conductive state at the beginning of the second horizontal period 1H(2), pairs of the source signal lines each configured by the source signal line to which +5V is applied and the source signal line to which −5V is applied are short-circuited. Consequently, charge sharing is performed between the two source signal lines, and the voltages of the source signal lines SLR1 to SLBm become 0V.

Next, as illustrated in FIG. 8(A), a positive red video signal and a positive blue video signal are respectively stored in red sub-pixels and blue sub-pixels in the second row connected to any of the source signal lines SLR1 to SLRm or the source signal lines SLB1 and connected to the gate signal line GL2. A negative green video signal is stored in green sub-pixels in the second row connected any of the source signal lines SLG1 to SLGm and connected to the gate signal line GL2. Thereafter, +5V is applied to the source signal lines SLR1 to SLRm and the source signal lines SLB1 to SLBm, and −5V is applied to the source signal lines SLG1 to SLGm. Consequently, regardless of the voltage of the video signal, the voltages of the source signal lines SLR1 to SLRm and SLB1 to SLBm become +5V, and the voltages of the source signal lines SLG1 to SLGm become −5V.

Next, as illustrated in FIG. 8(B), by making all of the discharge circuits 66 enter the conductive state at the beginning of the third horizontal period 1H(3), pairs of the source signal lines each configured by the source signal line to which +5V is applied and the source signal line to which −5V is applied are short-circuited. Consequently, charge sharing is performed between the two source signal lines, and the voltages of the source signal lines SLR1 to SLBm become 0V again.

Similarly, the video signals of the same polarity are stored in sub-pixels of respective colors to which the video signal is supplied to the source signal line every horizontal period until the n-th horizontal period 1H(n). Thereafter, +5V or −5V is applied to each of the source signal lines, and pairs of the source signal lines each configured by the source signal line to which +5V is applied and the source signal line to which −5V is applied are short-circuited. The operation of applying the next video signal to the source signal lines in which the voltages have become 0V as described above is repeated.

Figure 9:
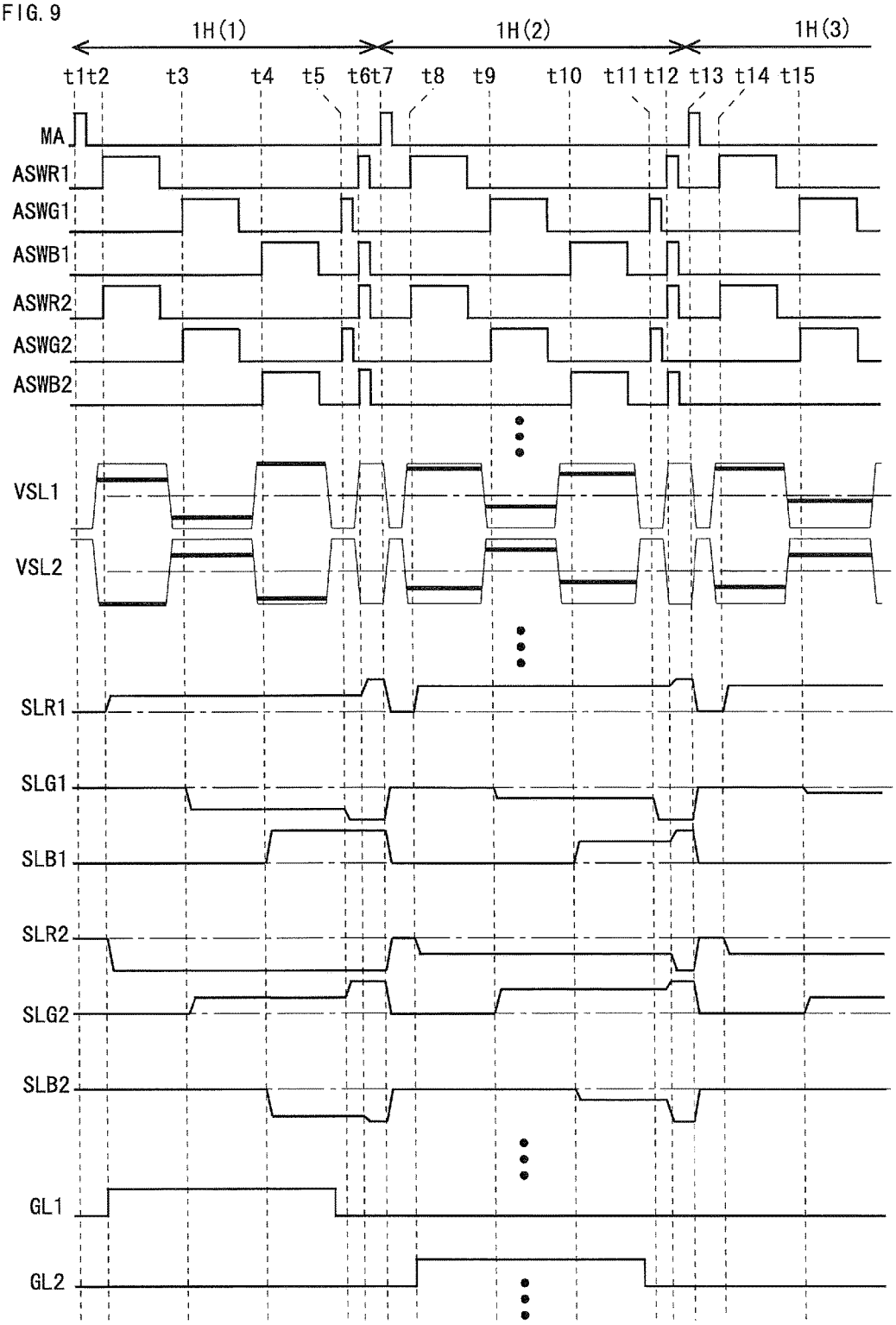
FIG. 9 is a timing chart illustrating operations of the liquid crystal display device according to the second embodiment.

FIG. 9 is a timing chart illustrating operations of the liquid crystal display device according to the present embodiment. As illustrated in FIG. 9, the levels of signals in the first horizontal period 1H(1) are the same as those of signals in the timing chart illustrated in FIG. 6. Consequently, the first horizontal period 1H(1) will be briefly described.

In the first horizontal period 1H(1), the red sub-pixel and the blue sub-pixel connected to the gate signal line GL1 store the positive video signal and the green sub-pixel stores the negative video signal. Moreover, +5V is applied to the source signal lines SLR1 to SLRm and SLB1 to SLBm, and −5V is applied to the source signal lines SLG1 to SLGm.

Next, the second horizontal period 1H(2) will be described. At time t7, the high level matching instruction signal MA is simultaneously supplied to all of the discharge circuits 66 in the charge matching circuit 65. Consequently, all of the discharge circuits 66 enter the conductive state, and pairs of the source signal lines connected via the discharge circuits 66 are short-circuited. As a result, charge sharing is performed between the two short-circuited source signal lines, and the voltages of the source signal lines SLR1 to SLBm become 0V.

At time t8, the high level selection signals ASWR1 to ASWRm are supplied to the selection circuits 50R1 to 50Rm connected to the source signal lines SLR1 to SLRm to which the display elements serving as the red sub-pixels are connected. Consequently, the selection circuits 50R1 to 50Rm enter the conductive state, and the positive red video signal which is output from the source driver 40 to the video signal lines VSL1 to VSLm is supplied to the source signal lines SLR1 to SLRm via the selection circuits 50R1 to 50Rm.

Next, the selection circuits ASWR1 to ASWRm become the low level, and at time t9, the high level selection signals ASWG1 to ASWGm are respectively supplied to the selection circuits 50G1 to 50Gm connected to the source signal lines SLG1 to SLGm to which the display elements serving as green sub-pixels are connected. Consequently, the selection circuits 50G1 to 50Gm enter the conductive state, and the negative green video signal which is output from the source driver 40 to the video signal lines VSL1 to VSLm is supplied to the source signal lines SLG1 to SLGm via the selection circuits 50G1 to 50Gm.

Subsequently, the selection circuits ASWG1 to ASWG2 become the low level, and at time t10, the high level selection signals ASWB1 to ASWBm are respectively supplied to the selection circuits 50B1 to 50Bm connected to the source signal lines SLB1 to SLBm to which the display elements serving as blue sub-pixels are connected. Consequently, the selection circuits 50B1 to 50Bm enter the conductive state, and the positive blue video signal which is output from the source driver 40 to the video signal lines VSL1 to VSLm is supplied to the source signal lines SLB1 to SLBm via the selection circuits 50B1 to 50Bm.

In a period after the voltage according to the red video signal is applied to the source signal lines SLR1 to SLRm until the voltage according to the blue video signal is applied to the source signal lines SLB1 to SLBm, the high level scanning signal is applied to the gate signal line GL2. Consequently, a positive red video signal is supplied to a pixel capacitance Cp in a red sub-pixel connected to the gate signal line GL2, a negative green video signal is supplied to a pixel capacitance Cp of a green sub-pixel, and a positive blue video signal is supplied to a pixel capacitance Cp of a blue sub-pixel. When the blue video signal is supplied to the blue sub-pixel, the scanning signal of the gate signal line GL2 is set to the low level. Therefore, the TFT 11 in each sub-pixel becomes the off state, the red sub-pixel and the blue sub-pixel connected to the gate signal line GL2 store the positive video signal, and the green sub-pixel stores the negative video signal. The positive video signal is supplied to the source signal lines SLR1 to SLRm and SLB1 to SLBm, and the negative video signal is supplied to the source signal lines SLG1 to SLGm.

Next, to apply −5V to the source signal lines SLG1 to SLGm to which the negative video signal is supplied, the high level selection signals ASWG1 to ASWGm are simultaneously supplied to the selection circuits 50G1 to 50Gm. Consequently, the selection circuits 50G1 to 50Gm enter the conductive state, and −5V is applied to each of the source signal lines SLG1 to SLGm. As a result, the voltages of the source signal lines SLG1 to SLGm become −5V regardless of the voltage of the green video signal applied at time t9.

Next, to apply +5V to the source signal lines SLR1 to SLRm and SLB1 to SLBm to which the positive video signal is supplied, the high level selection signals ASWR1 to ASWRm and ASWB1 to ASWBm are supplied to the selection circuits 50R1 to 50Rm and 50B1 to 50Bm, respectively. Consequently, the selection circuits 50R1 to 50Rm and 50B1 to 50Bm enter the conductive state, and +5V is applied to each of the source signal lines SLR1 to SLRm and SLB1 to SLBm. As a result, the voltages of the source signal line SLR1 to SLRm and SLB1 to SLBm becomes +5V regardless of the voltage of the red or blue video signal applied at time t8 or t10.

Next, the third horizontal period 1H(3) will be described. At time t13, the high level matching instruction signal MA is simultaneously supplied to the discharge circuits 66. Accordingly, all of the discharge circuits 66 enter the conductive state, and pairs of the source signal lines connected via the discharge circuits 66 are short-circuited. As a result, charge sharing is performed between the short-circuited source signal lines, and the voltages of the source signal lines SLR1 to SLBm become 0V. In this manner, the next video signal is applied to the source signal lines SLR1 to SLBm in which the voltages have become 0V.

Hereinafter, similarly, in odd-numbered horizontal periods, charge sharing is performed as in the first horizontal period 1H(1), the voltages of the source signal lines SLR1 to SLBm become 0V every horizontal period. In even-numbered horizontal periods, charge sharing is performed as in the second horizontal period 1H(2), and the voltages of the source signal lines SLR1 to SLBm become 0V every horizontal period.

2.3 Effects

In the liquid crystal display device which is column-reversal driven according to the present embodiment, by short-circuiting pairs of source signal lines, charge sharing is performed between source signal lines, and the voltages become 0V. In the case of applying a voltage according to the video signal of each color to such a source signal line in the next horizontal period, the voltage of the source signal line becomes the voltage according to a video signal without being influenced by the video signal applied in the immediately preceding horizontal period. Consequently, such a liquid crystal display device can display a color video image having reduced display unevenness and high uniformity.

The liquid crystal display device which is column-reversal-driven can be also used as a monochromatic display device of displaying, for example, only red video images. In this case, the reset voltage of the same polarity as that of voltage according to a video signal is alternately applied only to the source signal lines SLR1 to SLRm to which the video signal representing red is supplied, and charge sharing is performed between these source signal lines. However, the video signal is not supplied to the source signal lines SLG1 to SLGm and SLB1 to SLBm. Consequently, it is unnecessary to apply the reset voltage to the source signal lines SLG1 to SLGm and SLB1 to SLBm and perform charge sharing between these source signal lines. As descried above, in the monochromatic display device of displaying only red video images, the charge sharing can be performed efficiently since the charge sharing is performed only between the source signal lines SLR1 to SLRm. The operation is similarly performed in the case of displaying only green video images and in the case of displaying only blue video images.

3. Third Embodiment

3.1 Configuration of Liquid Crystal Display Device

Since a configuration of a liquid crystal display device according to a third embodiment of the present invention is the same as that of the liquid crystal display device according to the first embodiment illustrated in FIG. 1, diagrams and descriptions thereof are omitted.

Since the configuration and operation of the multiplexer and the charge matching circuit of the liquid crystal display device according to the present embodiment are the same as the configuration and operation of the multiplexer 50 and the charge matching circuit 60 of the liquid crystal display device according to the first embodiment illustrated in FIG. 3, diagrams and descriptions thereof are omitted.

3.2 Driving Method of Liquid Crystal Display Device

Since the liquid crystal display device according to the present embodiment is a display device which is dot-reversal-driven in a manner similar to the liquid crystal display device according to the first embodiment, a diagram illustrating dot-reversal driving and a description thereof are omitted.

Figure 10:
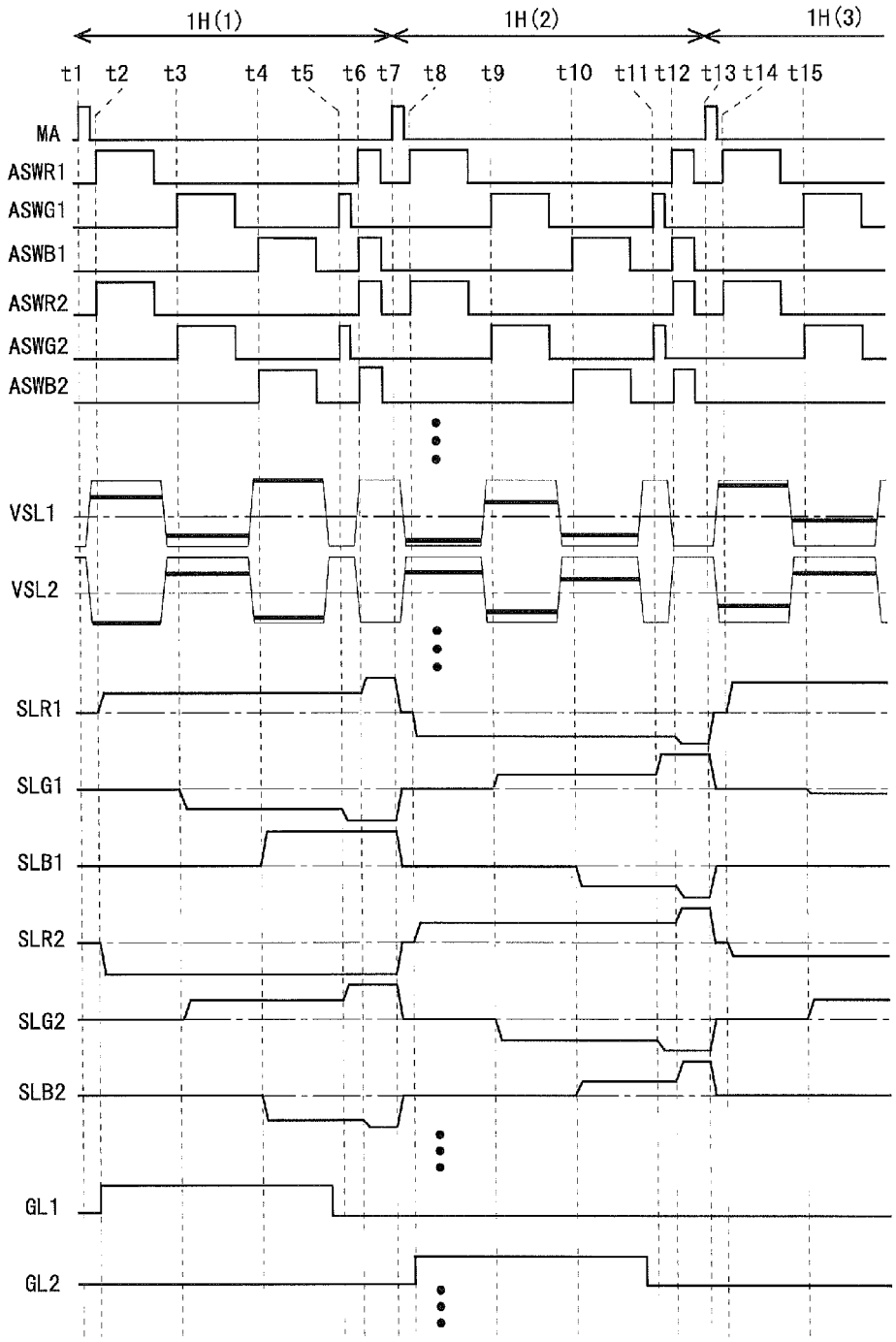
FIG. 10 is a timing chart illustrating operations of a liquid crystal display device according to a third embodiment.

FIG. 10 is a timing chart illustrating operations of a liquid crystal display device according to the present embodiment.

First, the first horizontal period 1H(1) will be described. As illustrated in FIG. 10, at time t1, the high level matching instruction signal MA is supplied from the display control circuit 20 to the charge matching circuit 60. Accordingly, all of the discharge circuits 61 in the charge matching circuit 60 enter the conductive state, and pairs of the source signal lines connected via the discharge circuits are short-circuited. As a result, charge sharing is performed between the short-circuited source signal lines, and the voltages of the source signal lines SLR1 to SLBm become 0V.

In a period from time t2 to time t5, in a manner similar to the case illustrated in FIG. 1, a positive video signal is supplied to a red sub-pixel and a blue sub-pixel, and a negative video signal is supplied to a green sub-pixel. A positive red video signal is supplied to the source signal lines SLR1 to SLRm, a negative green video signal is supplied to the source signal lines SLG1 to SLGm, and a positive blue video signal is supplied to the source signal lines SLB1 to SLBm.

Next, at time t5, to apply −5V to the source signal lines SLG1 to SLGm to which the negative video signal is supplied, the high level selection signals ASWG1 to ASWGm are simultaneously supplied to the corresponding selection circuits 50G1 to 50Gm. Consequently, the selection circuits 50G1 to 50Gm enter the conductive state, and −5V is applied to the source signal lines SLG1 to SLGm. As a result, the voltages of the source signal lines SLG1 to SLGm become −5V regardless of the voltage of the green video signal applied at time t3. The time to apply −5V to the source signal lines SLG1 to SLGm is set to the same time as that in the case of applying −5V to the source signal lines SLG1 to SLGm at time t5 in FIG. 1.

Next, at time t6, to apply +5V to the source signal lines SLR1 to SLRm and SLB1 to SLBm to which the positive video signal is supplied, the high level selection signals ASWR1 to ASWRm and ASWB1 to ASWBm are simultaneously supplied to the corresponding selection circuits 50R1 to 50Rm and 50B1 to 50Bm, respectively. Consequently, the selection circuits 50R1 to 50Rm and 50B1 to 50Bm enter the conductive state, and +5V is applied to the source signal lines SLR1 to SLRm and SLB1 to SLBm. As a result, the voltages of the source signal lines SLR1 to SLRm and SLB1 to SLBm become +5V regardless of the voltage of the red or blue video signal applied at time t2 or t4. At this time, the time to apply +5V to the source signal lines SLR1 to SLRm and SLB1 to SLBm is set to about twice as long as the time in the case of applying −5V to the source signal lines SLG1 to SLGm at time t5.

Next, the second horizontal period 1H(2) will be described. At time t7, the high level matching instruction signal MA is simultaneously supplied to all of the discharge circuits 61 in the charge matching circuit 60. Accordingly, all of the discharge circuits 61 enter the conductive state, and pairs of the source signal lines connected via the discharge circuits 61 are short-circuited. As a result, charge sharing is performed between the short-circuited source signal lines, and the voltages of the source signal lines SLR1 to SLBm become 0V.

In a period from time t8 to time t11, as in the case illustrated in FIG. 1, a negative video signal is supplied to a red sub-pixel and a blue sub-pixel, and a positive video signal is supplied to a green sub-pixel. The negative red video signal is supplied to the source signal lines SLR1 to SLRm, the positive green video signal is supplied to the source signal lines SLG1 to SLGm, and the negative blue video signal is supplied to the source signal lines SLB1 to SLBm.

Next, at time t11, to apply +5V to the source signal lines SLG1 to SLGm to which the positive video signal is supplied, the high level selection signals ASWG1 to ASWGm are simultaneously supplied to the selection circuits 50G1 to 50Gm, respectively. Consequently, the selection circuits 50G1 to 50Gm enter the conductive state, and +5V is applied to the source signal lines SLG1 to SLGm. At this time, the time to apply +5V to the source signal lines SLG1 to SLGm is set to the same time as in the case of applying −5V to the source signal lines SLG1 to SLGm at time t11 in FIG. 1.

Next, at time t12, to apply −5V to the source signal lines SLR1 to SLRm and SLB1 to SLBm to which the negative video signal is supplied, the high level selection signals ASWR1 to ASWRm and ASWB1 to ASWBm are simultaneously supplied to the selection circuits 50R1 to 50Rm and 50B1 to 50Bm, respectively. Consequently, the selection circuits 50R1 to 50Rm and 50B1 to 50Bm enter the conductive state, and −5V is applied to the source signal lines SLR1 to SLRm and SLB1 to SLBm. As a result, the voltages of the source signal lines SLR1 to SLRm and SLB1 to SLBm become −5V regardless of the voltage of the red or blue video signal applied at time t8 or t10. At this time, the time to apply −5V to the source signal lines SLR1 to SLRm and SLB1 to SLBm is set to about twice as long as the time in the case of applying +5V to the source signal lines SLG1 to SLGm at time t11.

Next, the third horizontal period 1H(3) will be described. At time t13, the high level matching instruction signal MA is simultaneously supplied to all of the discharge circuits 61 in the charge matching circuit 60. Accordingly, all of the discharge circuits 61 enter the conductive state, and pairs of the source signal lines connected to the discharge circuits 61 are short-circuited. As a result, charge sharing is performed between the short-circuited source signal lines, and the voltages of the source signal lines SLR1 to SLBm become 0V. In this manner, the next video signal is supplied to the source signal lines SLR1 to SLBm in which the voltages have become 0V.

Hereinafter, similarly, in odd-numbered horizontal periods, charge sharing is performed as in the first horizontal period 1H(1), the voltages of the source signal lines SLR1 to SLBm become 0V every horizontal period. In even-numbered horizontal periods, charge sharing is performed as in the second horizontal period 1H(2), and the voltages of the source signal lines SLR1 to SLBm become 0V every horizontal period.

In the present embodiment, the reason why the time to apply the reset voltage to the source signal lines SLR1 to SLRm and the source signal lines SLB1 to SLBm is made longer than the time to apply the reset voltage to the source signal lines SLG1 to SLGm will be described. For example, in the first horizontal period 1H(1), the selection signal ASWG1 is supplied to the selection circuit 50G1, the source signal line SLG1 is connected to the video signal line VSL1, and the source signal line SLG1 is charged to −5V. On the other hand, to charge the source signal lines SLR1 and SRB1 to +5V, the selection signals ASWR1 and ASWB1 need to be supplied to the selection circuits 50R1 and 50B1, respectively, and the source signal lines SLR1 and SLB1 need to be simultaneously connected to the video signal line VSL1 to be charged. At this time, when the charge time of the two source signal lines SLR1 and SLB1 connected to the video signal line VSL1 is set to the same as the charge time of one source signal line SLG1, a case occurs in which the charge time is finished before the voltages of the source signal lines SLR1 and SLB1 to be charged to +5V become +5V and the source signal lines SLR1 and SLB1 are only charged to a voltage lower than +5V. In this case, even when the source signal line SLG1 charged to −5V and the source signal line SLR1 charged only to a voltage lower than +5V are short-circuited, the voltages do not become 0V.

By setting the time to charge the source signal lines SLR1 and SLB1 connected to the video signal line VSL1 to +5V to about twice as long as the time to charge the source signal line SLG1 to −5V, each of the source signal lines SLR1 and SLB1 is reliably charged to +5V. Consequently, by short-circuiting the source signal line SLR1 and the source signal line SLG1, the voltages of these source signal lines become 0V.

In the above description, the time to charge the source signal lines SLR1 and SLB1 connected to the video signal line VSL1 to +5V is set to, not twice, but "about twice" as long as the time to charge the source signal line SLG1 to −5V. The reason of setting "about twice" is as follows. Charging is finished in a short time when the value of current for charging the source signal lines SLR1 and SLB1 is large, and on the contrary, it takes a long time when the current value is small, so that the twice as long time is not always necessary even when the number of source signal lines to be charged becomes twice. More generally, even in the case of setting the current value to be large so that the charging is finished in a short time, time to charge the two source signal lines SLR1 and SLB1 connected simultaneously to the video signal line VSL1 to +5V is longer than time to charge one source signal line SLR1 to −5V. Although the source signal lines SLR1, SLG1, and SLB1 in the first horizontal period 1H(1) have been described above, the other source signal lines in the other horizontal periods are similar to the above.

3.3 Effects

In the liquid crystal display device which is dot-reversal-driven according to the present embodiment, the time to charge the source signal lines SLR1 to SLRm and SLB1 to SLBm connected to the video signal lines VSL1 to VSLm to +5V or −5V is set to about twice as long as the time to charge the source signal lines SLG1 to SLGm to −5V or +5V. Thus, the voltages of the source signal lines SLR1 to SLB1 can be reliably charged to +5V or −5V. By short-circuiting the source signal lines charged in this manner, the voltages become 0V with reliability. As a result, the voltage according to the next video signal is applied to the source signal line which has become 0V, so that a color video image having further reduced display unevenness and higher uniformity can be displayed.

3.4 Modification

In the foregoing embodiment, the case has been described in which the time to apply +5V or −5V to the source signal lines SLR1 to SLRm and SLB1 to SLBm is made longer than the time to apply −5V or +5V to the source signal lines SLG1 to SLGm in the liquid crystal display device of the dot-reversal-drive type according to the first embodiment. Similarly, also in the liquid crystal display device which is line-reversal-driven according to the second embodiment, the time to apply +5V or −5V to the source signal lines SLR1 to SLRm and SLB1 to SLBm can be made longer than the time to apply −5V or +5V to the source signal lines SLG1 to SLGm. Also in this case, effects similar to those of the present embodiment are achieved.

Moreover, in the foregoing embodiment, the number of the source signal lines to which +5V is applied is twice as many as the number of the source signal lines to which −5V is applied. However, the number is not limited to twice, and may be three times or more or may be equal to or less than a half. By increasing the time to apply +5V or −5V in accordance with the number of source signal lines, all of the source signal lines can be charged to the reset voltage.

4. Modifications Common to Embodiments

4.1 First Modification

Figure 11:
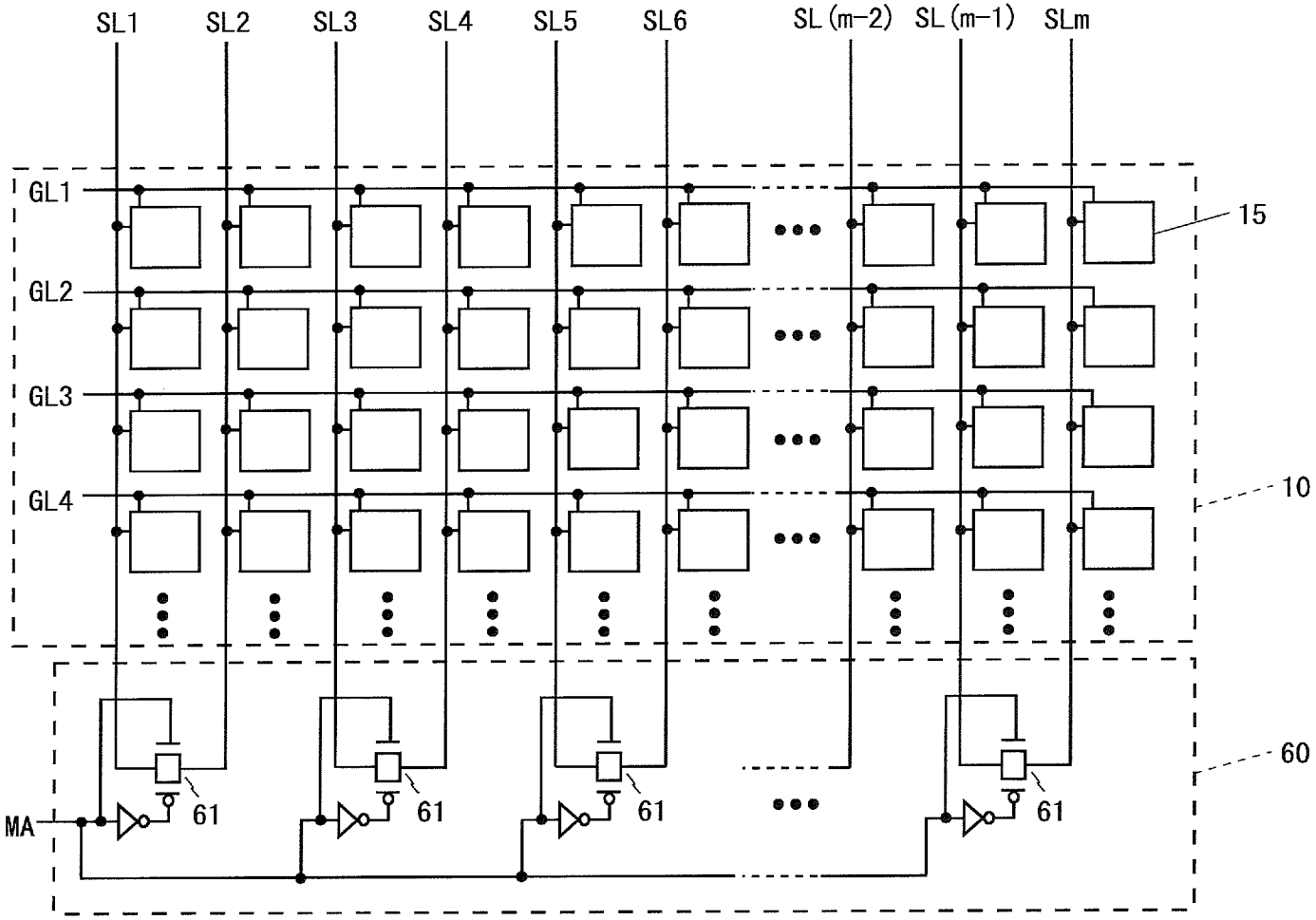
FIG. 11 is a diagram illustrating a configuration of a display unit including a charge matching circuit in a first modification of the liquid crystal display device shown in FIG. 1.

FIG. 11 is a diagram illustrating the configuration of the display unit 10 including the charge matching circuit 60 in a first modification of the liquid crystal display device according to the first embodiment. Reference numerals which are the same as or which correspond to the components illustrated in FIG. 3 are denoted to components illustrated in FIG. 11.

The liquid crystal display device according to the first embodiment is the liquid crystal display device capable of displaying a color video image. However, the present invention can be applied also to a liquid crystal display device which cannot display a color video image. In this case, since video signals output from the source driver do not include video signals of respective colors, it is not necessary to provide a selection circuit for selecting video signals of respective colors to be supplied to the source signal lines SL1 to SLm. Consequently, the video signal output from the source driver and +5V and −5V are applied directly to the source signal lines SL1 to SLm.

Also in such a liquid crystal display device, +5V and −5V is applied to two adjacent source signal lines every horizontal period, and pairs of the source signal lines are short-circuited. Consequently, charge sharing is performed between the source signal line to which +5V is applied and the source signal line to which −5V is applied, and the voltages of the source signal lines SL1 to SLm becomes 0V. Therefore, as in the liquid crystal display device according to the first embodiment, the liquid crystal display device according to the present modification can also display a video image having reduced display unevenness and high uniformity.

By employing a configuration similar to that of the first modification, the liquid crystal display device according to the second embodiment can also display a video image having reduced display unevenness and high uniformity.

4.2 Second Modification

Figure 12:
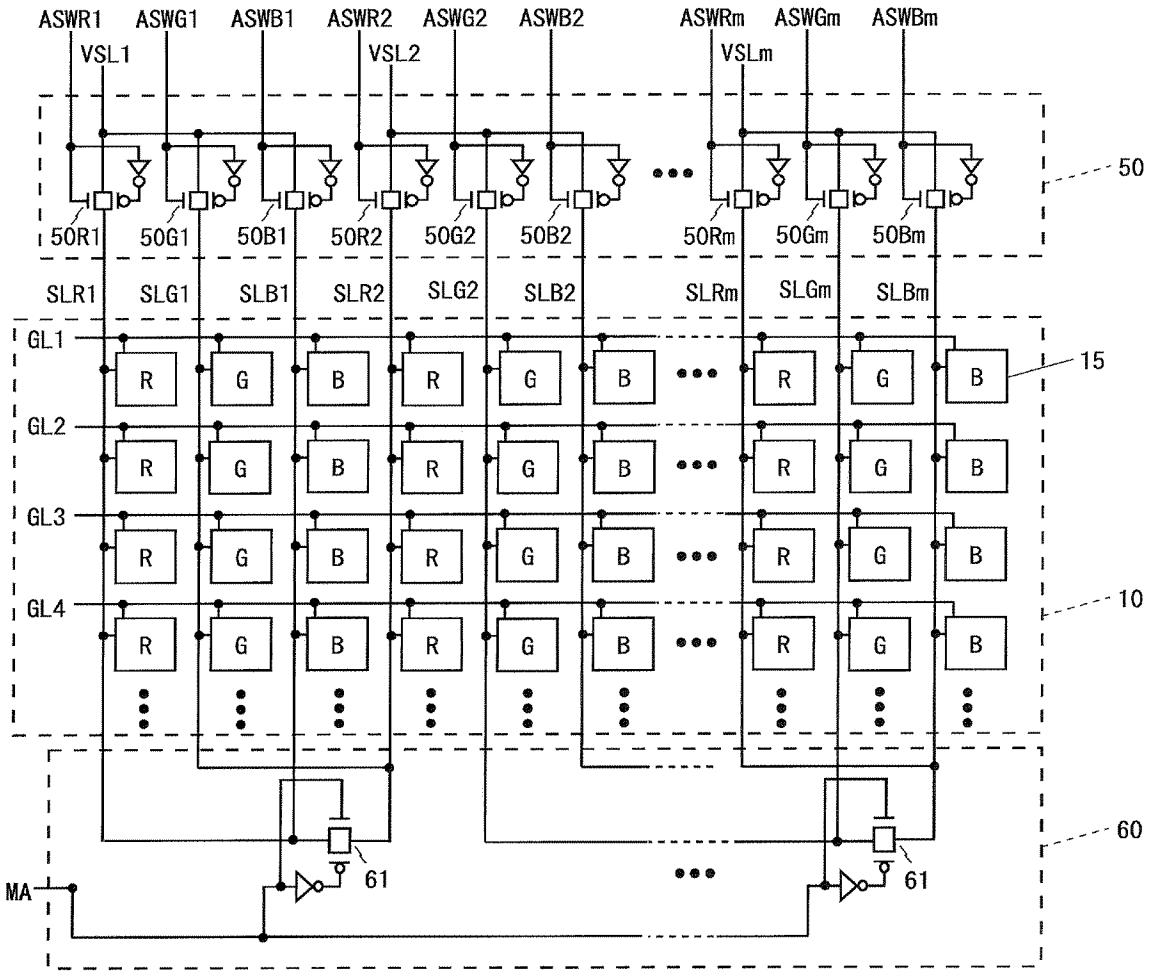
FIG. 12 is a diagram illustrating a configuration of a display unit including a charge matching circuit in a second modification of the liquid crystal display device shown in FIG. 1.

FIG. 12 is a diagram illustrating the configuration of the display unit 10 including the charge matching circuit 60 in a second modification of the liquid crystal display device according to the first embodiment. Reference numerals which are the same as or which correspond to the components illustrated in FIG. 3 are denoted to components illustrated in FIG. 11.

Although every two adjacent source signal lines are short-circuited by using the discharge circuit 61 in the liquid crystal display device according to the first embodiment, every four source signal lines may be short-circuited by using the discharge circuit 61. In this case, +5V is applied to two source signal lines out of four source signal lines connected by the discharge circuit 61, and −5V is applied to the other two source signal lines. By connecting the four source signal lines by the discharge circuit 61 and setting the discharge circuit 61 to the conductive state, the source signal lines are short-circuited. Accordingly, the voltage of each of the source signal lines SLR1 to SLBm can be set to 0V. Consequently, as in the liquid crystal display device according to the first embodiment, the liquid crystal display device according to the present modification can also display a video image with reduced display unevenness and high uniformity.

With respect to the number of source signal lines connected by the discharge circuit 61, it is sufficient that the number of source signal lines to which +5V is applied equal to the number of source signal lines to which −5V is applied, and the number is not limited to two or four. By employing a configuration similar to that of the first modification also in the liquid crystal display device according to the second embodiment, a video image having reduced display unevenness and high uniformity can be displayed.

4.3 Other Modifications

Although the liquid crystal display device has been described by way of example in each of the foregoing embodiments, the present invention is not limited to the liquid crystal display device. The present invention can also be applied to an organic EL (Electro Luminescence) display device and the like.

INDUSTRIAL APPLICABILITY

The present invention is applied to a matrix-type display device such as an active-matrix-type liquid crystal display device, and is particularly suitable to a display device performing charge sharing.

DESCRIPTION OF REFERENCE CHARACTERS

10: DISPLAY UNIT
15: DISPLAY ELEMENT
30: GATE DRIVER (SCANNING SIGNAL LINE DRIVE CIRCUIT)
40: SOURCE DRIVER (DATA SIGNAL LINE DRIVE CIRCUIT)
50: MULTIPLEXER
50R1 to 50Bm: SELECTION CIRCUIT
60, 65: CHARGE MATCHING CIRCUIT
61, 66: DISCHARGE CIRCUIT
VSL1 to VSLm: VIDEO SIGNAL LINE
SLR1 TO SLBm: SOURCE SIGNAL LINE (SUB DATA SIGNAL LINE)
SL1 to SLm: SOURCE SIGNAL LINE (DATA SIGNAL LINE)
GL1 to GLn: GATE SIGNAL LINE (SCANNING SIGNAL LINE)
ASWR1 TO ASWBm: SELECTION SIGNAL
MA: MATCHING SIGNAL

The invention claimed is:

1. An active matrix-type display device comprising:

a display unit having a plurality of data signal lines, a plurality of scanning signal lines intersecting the plurality of data signal lines, and a plurality of pixels arranged in a matrix form at respective intersections of the plurality of data signal lines and the plurality of scanning signal lines;

a scanning signal line drive circuit sequentially selecting and activating the plurality of scanning signal lines;

a data signal line drive circuit which alternately applies a positive voltage and a negative voltage to the data signal lines; and a plurality of discharge circuits connecting the data signal lines to which the positive voltage is applied and the data signal lines to which the negative voltage is applied, the number of the data signal lines to which the positive voltage is applied being equal to the number of the data signal lines to which the negative voltage is applied, wherein the data signal line drive circuit alternately applies the positive voltage and the negative voltage according to the video signal to the data signal lines, and then applies first reset voltages whose absolute values are equal, and whose polarities are the same as those of the voltages according to the video signal to each of the data signal lines, and after the first reset voltages are applied to the data signal lines every horizontal period, the discharge circuit short-circuits the data signal lines connected to the discharge circuit.

2. The display device according to claim 1, further comprising a selection circuit which divides the video signal including a plurality of color video signals representing video images of a plurality of colors, by each of the color video signals, wherein each of the pixels arranged in the display unit includes a plurality of sub-pixels corresponding to the plurality of color video signals, the data signal line includes a video signal line which time-divisionally divides the plurality of color video signals and outputs the resultant signals, and a plurality of sub data signal lines connected to the plurality of sub-pixels, the selection circuit supplies the voltages according to the plurality of color video signals to the plurality of sub data signal lines, the discharge circuit connects the sub data signal lines to which the positive voltage is applied and the sub data signal lines to which the negative voltage is applied, the number of the sub data signal lines to which the positive voltage is applied being equal to the number of the sub data signal lines to which the negative voltage is applied, the data signal line drive circuit alternately applies the positive voltage and the negative voltage according to the color video signal to each of the sub data signal lines, and then applies second reset voltages whose absolute values are equal to and whose polarities are the same as those of the voltages according to the color video signal to each of the data signal lines, and after the second reset voltages are applied to the sub data signal lines every horizontal period, the discharge circuit short-circuits the sub data signal lines connected to the discharge circuit.

3. The display device according to claim 2, wherein time to apply the second reset voltage to the sub data signal line increases as the number of the sub data signal lines connected to each of the video signal lines increases.

4. The display device according to claim 2, wherein the absolute value of the second reset voltage is equal to or less than the absolute value of maximum voltage and minimum voltage according to the color video signal.

5. The display device according to claim 2, wherein the selection circuit is configured by an analog switch.

6. The display device according to claim 2, wherein the discharge circuit connects two adjacent sub data signal lines.

7. The display device according to claim 2, wherein the discharge circuit connects two closest sub data signal lines out of sub data signal lines to which the color video signal of the same color is supplied.

8. The display device according to claim 2, wherein the pixel includes a red sub-pixel, a green sub-pixel, and a blue sub-pixel.

9. The display device according to claim 8, wherein the second reset voltages of different polarities are applied to the sub data signal line connected to the red sub-pixel and the blue sub-pixel, and the sub data signal line connected to the green sub-pixel, respectively, and time to apply the second reset voltages to the sub data signal lines connected to the red sub-pixel and the sub data signal lines connected to the blue sub-pixel is longer than time to apply the second reset voltages to the sub data signal lines connected to the green sub-pixel.

10. The display device according to claim 2, wherein the data signal line drive circuit performs dot-reversal driving.

11. The display device according to claim 2, wherein the data signal line drive circuit performs column-reversal driving.

12. A driving method of an active matrix-type display device including:

a display unit having a plurality of data signal lines, a plurality of scanning signal lines intersecting the plurality of data signal lines, and a plurality of pixels arranged in a matrix form at respective intersections of the plurality of data signal lines and the plurality of scanning signal lines, a scanning signal line drive circuit sequentially selecting and activating the plurality of scanning signal lines, a data signal line drive circuit which alternately applies a positive voltage and a negative voltage to the data signal lines, and a plurality of discharge circuits connecting the data signal lines to which the positive voltage is applied and the data signal lines to which the negative voltage is applied, the number of the data signal lines to which the positive voltage is applied being equal to the number of the data signal lines to which the negative voltage is applied, the method comprising:

a first voltage applying step of alternately applying a positive voltage and a negative voltage according to a video signal to the data signal lines;

a second voltage applying step of, after application of the positive voltage and the negative voltage according to the video signal, applying a first reset voltage whose absolute value is equal, and whose polarity is the same as that of the voltage according to the video signal to each of the data signal lines; and a short-circuiting step of short-circuiting data signal lines connected to the discharge circuit by making the discharge circuit conductive after application of the first reset voltage every horizontal period.

13. The driving method of the display device according to claim 12, wherein the display device further includes a selection circuit which divides the video signal including a plurality of color video signals representing video images of a plurality of colors, by color video signals, each of the pixels arranged in the display unit includes a plurality of sub-pixels corresponding to the plurality of colors, the data signal line includes a video signal line which time-divisionally divides the plurality of color video signals and outputs the resultant signals, and a plurality of sub data signal lines connected to the sub-pixels, in the first voltage applying step, the positive voltage and the negative voltage according to the plurality of color video signals are alternately applied to the plurality of sub data signal lines, in the second voltage applying step, the voltages according to the plurality of color video signals are applied to the plurality of sub data signal lines, and then, second reset voltages whose absolute values are equal to and whose polarities are the same as those of the voltages according to the color video signal are applied to each of the sub data signal lines, and in the short-circuiting step, after the second reset voltages are applied every horizontal period, the data signal lines connected to the discharge circuit are short-circuited.

* * * * *